US008826839B2

(12) United States Patent
Bodanese et al.

(10) Patent No.: US 8,826,839 B2
(45) Date of Patent: Sep. 9, 2014

(54) METHODS AND SYSTEMS FOR FPSO DECK MATING

(75) Inventors: Luiz Germano Bodanese, Rio de Janeiro (BR); Edward E. Horton, III, Houston, TX (US); James V. Maher, IV, Houston, TX (US); Rafael Louzada Bodanese, Rio de Janeiro (BR); Xavier Castello, Rio de Janeiro (BR); Rodrigo M. R. Guimares, Rio de Janeiro (BR)

(73) Assignee: Horton do Brasil Technologia Offshore, Ltda, Houston, TX (US)

( * ) Notice: Subject to any disclaimer, the term of this patent is extended or adjusted under 35 U.S.C. 154(b) by 134 days.

(21) Appl. No.: 13/599,839

(22) Filed: Aug. 30, 2012

(65) Prior Publication Data

US 2013/0233224 A1 Sep. 12, 2013

Related U.S. Application Data

(60) Provisional application No. 61/528,852, filed on Aug. 30, 2011.

(51) Int. Cl.
*B63C 1/02* (2006.01)
*B63B 9/06* (2006.01)

(52) U.S. Cl.
CPC . *B63C 1/02* (2013.01); *B63B 9/065* (2013.01); *B63B 2009/067* (2013.01)
USPC ..... 114/45; 414/137.1; 414/803

(58) Field of Classification Search
USPC ..... 114/45, 46, 267; 414/137.1, 803; 405/3, 405/4, 12, 203, 204, 209, 206
See application file for complete search history.

(56) References Cited

U.S. PATENT DOCUMENTS

| | | | | |
|---|---|---|---|---|
| 4,729,695 | A * | 3/1988 | Silvestri | 405/204 |
| 5,924,822 | A * | 7/1999 | Finn et al. | 405/209 |
| 6,299,383 | B1 * | 10/2001 | Finn et al. | 405/209 |
| 6,935,810 | B2 | 8/2005 | Horton | |
| 7,527,006 | B2 * | 5/2009 | Khachaturian | 405/204 |
| 7,610,869 | B2 * | 11/2009 | Thomas | 414/137.1 |

FOREIGN PATENT DOCUMENTS

| | | | |
|---|---|---|---|
| EP | 1060982 | A2 | 12/2000 |
| KR | 20110083241 | A | 7/2011 |
| WO | 01/53609 | A1 | 7/2001 |
| WO | 2004/110855 | A2 | 12/2004 |
| WO | 2010/098898 | A1 | 9/2010 |

OTHER PUBLICATIONS

PCT/US2012/053175 International Search Report and Written Opinion Dated Feb. 27, 2013 (11 p.).

* cited by examiner

*Primary Examiner* — Lars A Olson
(74) *Attorney, Agent, or Firm* — Conley Rose, P.C.

(57) ABSTRACT

A method for constructing an FPSO comprises (a) assembling and integrating a plurality of modules to form a module assembly for installation on the FPSO. In addition, the method comprises (b) supporting the module assembly with one or more ballast adjustable pontoons. Further, the method comprises (c) positioning the module assembly over a deck of a vessel after (a) and (b). Still further the method comprises (d) de-ballasting the vessel and/or ballasting the one or more pontoons to load the module assembly onto the deck of the vessel after (c).

20 Claims, 22 Drawing Sheets

METHODS AND SYSTEMS FOR FPSO DECK MATING

CROSS-REFERENCE TO RELATED APPLICATIONS

This application claims benefit of U.S. provisional patent application Ser. No. 61/528,852 filed Aug. 30, 2011, and entitled "Methods and Systems for FPSO Deck Making," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to floating production and offloading units (FPSOs). More particularly, the invention relates to methods and systems for installing pre-integrated processing modules on an FPSO.

2. Background of the Technology

Floating Production Storage and Offloading units (FPSOs) are commonly used in offshore oil and gas operations to temporarily store and then offload produced oil. An FPSO vessel is designed to receive crude oil produced from a nearby platform or subsea template, process the crude oil (e.g., separate water from the crude oil), and store the processed oil until it can be offloaded to a tanker or transported through a pipeline. FPSOs are particularly suited in frontier offshore regions where there is no pipeline infrastructure in place for transporting produced oil to shore. For example, FPSOs are often employed to store produced oil until it can be offloaded to a tanker for transport to another location.

Typically, FPSOs are ship-shaped floating vessels that provide a relatively large oil storage volume, various production modules, personnel accommodations, and equipment. In general, FPSOs may be constructed from scratch as a new vessel or by transforming the hull of an old oil tanker. In either case, the construction of an FPSO requires the installation of a number of modules such as modules for power generation, fluid separation, utilities, water treatment and gas compression. In some cases, the number of modules installed is relatively large (e.g., upwards of 15-18 modules).

Conventionally, the modules are constructed at different sites, often by separate entities, loaded onto the deck of the FPSO with cranes, and then assembled, integrated and commissioned on top of the FPSO. Due to the weight of each module, and the load capacity of cranes, the modules are typically loaded onto the FPSO one-by-one. Consequently, the time and cost to finalize an FPSO project is constrained by the operational challenges of loading the modules onto the FPSO, assembling and integrating the modules once loaded onto the FPSO, and then commissioning modules aboard the FPSO. In addition, for refurbished FPSOs, conversion of the old oil tanker's hull may require unanticipated repairs and/or reinforcements that may further constrain loading, assembly, integration, and commissioning of the modules, thereby further increasing costs and delay delivery of the completed FPSO.

Accordingly, there remains a need in the art for improved methods and systems for constructing FPSOs, and in particular, for loading and installing modules onto an FPSO. Such methods and systems would be particularly well-received if they offered the potential to reduce the time, and associated costs, to load, install, and integrate the modules.

BRIEF SUMMARY OF THE DISCLOSURE

These and other needs in the art are addressed in one embodiment by a method for constructing an FPSO. In an embodiment, the method comprises (a) assembling and integrating a plurality of modules to form a module assembly for installation on the FPSO. In addition, the method comprises (b) supporting the module assembly with one or more ballast adjustable pontoons. Further, the method comprises (c) positioning the module assembly over a deck of a vessel after (a) and (b). Still further the method comprises (d) de-ballasting the vessel and/or ballasting the one or more pontoons to load the module assembly onto the deck of the vessel after (c).

These and other needs in the art are addressed in another embodiment by a system for installing a pre-assembled and pre-integrated module assembly on a vessel disposed in a body of water to form an FPSO. In an embodiment, the system comprises a floating vessel configured to be ballasted and de-ballasted. In addition, the system comprises a pair of horizontally spaced parallel pontoons defining an open bay configured to receive the floating vessel. Each pontoon is ballast adjustable. Further, the system comprises a support system coupled to the pontoons and configured to support the module assembly over the open bay.

These and other needs in the art are addressed in another embodiment by a method for constructing an FPSO. In an embodiment, the method comprises (a) assembling and integrating a plurality of modules on-shore to form a module assembly for installation on the FPSO. In addition, the method comprises (b) coupling the module assembly to a support system moveably disposed on a plurality of rails after (a). Further, the method comprises (c) moving the module assembly along the rails to a position over a deck of a vessel. Still further, the method comprises (d) transferring the module assembly from the support system to the deck of the vessel after (c).

These and other needs in the art are addressed in another embodiment by a system for installing a pre-assembled and pre-integrated module assembly on a vessel disposed in a body of water to form an FPSO. In an embodiment, the system comprises an integration area including a pair of first rails. In addition, the system comprises a plurality of second rails extending from the integration area over the surface of water. Each second rail is aligned with one of the first rails. Further, the system comprises a carriage moveably coupled to each first rail and each second rail. Still further, the system comprises a support system coupled to the carriages and configured to support the module assembly.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
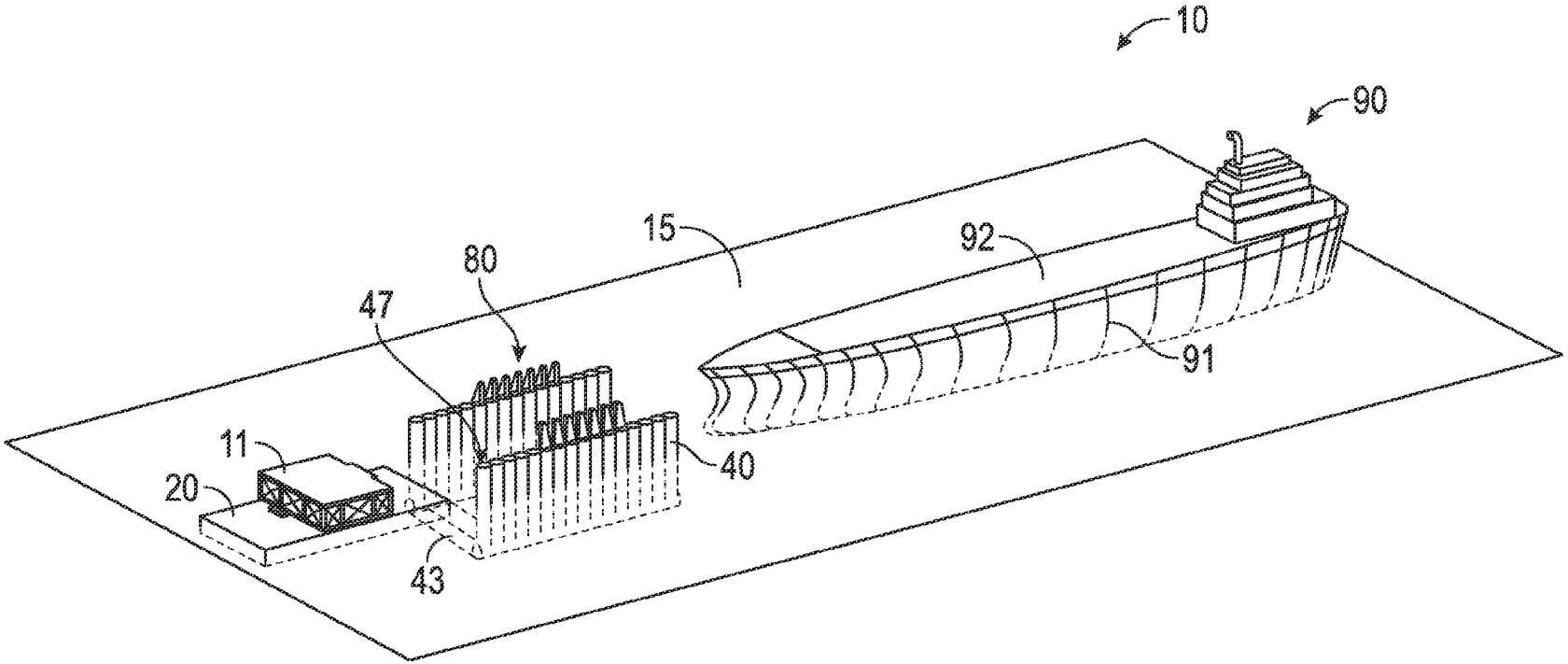
FIGS. 1-4 are sequential perspective views illustrating an embodiment of a method for installing a pre-integrated module assembly onto an FPSO hull in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Embodiments described herein disclose multiple deck-mating systems and methods for installing a plurality of pre-integrated modules onto the deck of a floating hull to faun an FPSO. Such deck-mating systems and methods enable the modules to be built and integrated while the FPSO is under construction or transformation, thereby reducing the number of integrations performed aboard an FPSO after the modules are loaded thereon. In particular, multiple modules are built and pre-integrated simultaneous with (i.e., in parallel with) the fabrication or transformation of the FPSO hull. When the FPSO hull is ready to receive the modules, a significant portion of the module integration has already been performed and the pre-integrated modules may be installed at the same time, thereby offering the potential to reduce the total time expended for module integration and enable timely delivery of the completed FPSO.

Referring now to FIGS. 1-4, a system 10 for constructing an offshore FPSO is shown. In this embodiment, system 10 includes a module assembly 11, a first floating barge 20, a second floating barge 40, a module support system 80, and a vessel 90. As will be described in more detail below, first barge 20 transports module assembly 11 from the shore to second barge 40, and second barge 40 transports module assembly 11 to vessel 90 and loads module assembly 11 onto vessel 90 for installation thereon to construct an FPSO. Thus, first barge 20 may also be referred to as a load out barge, and second barge 40 may also be referred to as a transfer barge.

Module assembly 11 comprises a plurality of modules typically installed on an FPSO. As is known in the art, modules installed on an FPSO include, without limitation, modules for power generation, fluid separation, utilities, water treatment, and gas compression. In embodiments described herein, a plurality of such modules are built, assembled, and integrated to form assembly 11 prior to being loaded and installed on vessel 90. In particular, module assembly 11 is assembled and integrated on-shore, and then transported to vessel 90 and installed thereon to form an FPSO.

First barge 20 is a conventional buoyant flat barge sized and configured to support module assembly 11 above the surface of the water 15. Thus, first barge 20 has a buoyancy sufficient to support the entire weight of module assembly 11 above the surface of water 15.

Figure 5:
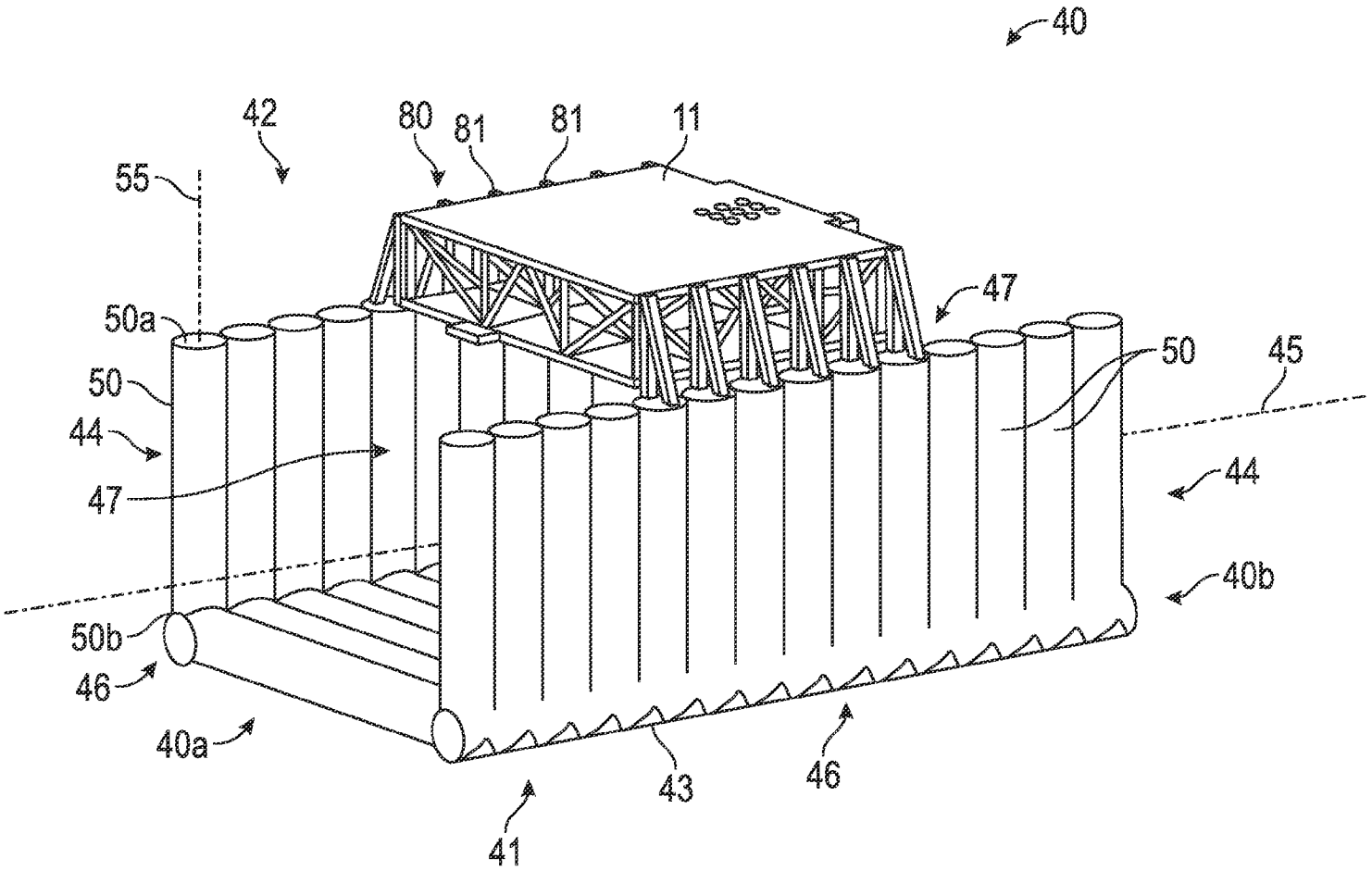
FIG. 5 is an enlarged view of the second barge and module assembly of FIGS. 1-4.

Referring now to FIG. 5, second barge 40 is a buoyant, ballast adjustable offshore structure. In other words, second barge 40 can be controllably ballasted and de-ballasted to adjust its draft (i.e., vertical position relative to the surface of the water 15). In this embodiment, barge 40 is generally U-shaped having a central or longitudinal axis 45, a first open end 40*a*, a second open end 40*b* opposite first end 40*a*, a closed bottom 41 extending horizontally between ends 40*a, b* below axis 45, and an open top 42 extending between ends 40*a, b* above axis 45. In addition, barge 40 includes a horizontal base 43 forming closed bottom 41, and a pair of spaced parallel vertical walls 44 extending perpendicularly upward from base 43. Horizontal base 43 extends parallel to axis 45 from end 40*a* to end 40*b*, and has a pair of lateral sides 46 extending between ends 40*a, b*. In this embodiment, base 43 is generally rectangular, and thus, lateral sides 46 are parallel to each other. One wall 44 extends vertically upward from each lateral side 46.

Each wall 44 comprises a plurality of vertical, ballast adjustable buoyant columns 50 arranged side-by-side in an axial row. Each column 50 has a central or longitudinal axis 55, a first or upper end 50*a* at top 42, and a second or lower end 50*b* coupled to one lateral side 46 of base 43. In addition, each column 50 has a length $L_{50}$ measured parallel to axis 55 between ends 50*a, b*, and a diameter $D_{50}$ measured perpendicular to axis 55. In general, the length $L_{50}$ and the diameter $D_{50}$ of each column 50 may be tailored to the anticipated loads, FPSO construction site and associated water depth. For most cases, the diameter $D_{50}$ of each column 50 is between 5 and 10 m. In this embodiment, each column 50 is identical.

Spaced walls 44 and associated columns 50 define a passage or bay 47 extending between ends 40*a, b* of second barge 40. Bay 47 has a length $L_{47}$ measured parallel to axis 45 between ends 40*a, b*, and a width $W_{47}$ measured perpendicular to axis 45 between walls 44. As will be described in more detail below, bay 47 is sized to receive first barge 20, module assembly 11, and vessel 90, and second barge 40 supports the weight of module assembly 11. Thus, the actual width $W_{47}$ of bay 47 will depend on a variety of factors including, without limitation, the width of first barge 20, the width of module assembly 11, and the beam (i.e., width) of vessel 90; and the actual length $L_{47}$ of bay 47 will depend on variety of factors including, without limitation, the number of buoyant columns 50 in wall 44 required to support the weight of module assembly 11. For most applications, the width $W_{47}$ ranges from 35 to 60 m and the length $L_{50}$ ranges from 60 to 100 m. It should be appreciated that the length $L_{47}$ and the width $W_{47}$ of bay 47 can be adjusted by increasing the dimensions of base 43 (i.e., length and width), adding more columns 50 to each wall 44, or combinations thereof.

Figure 6:
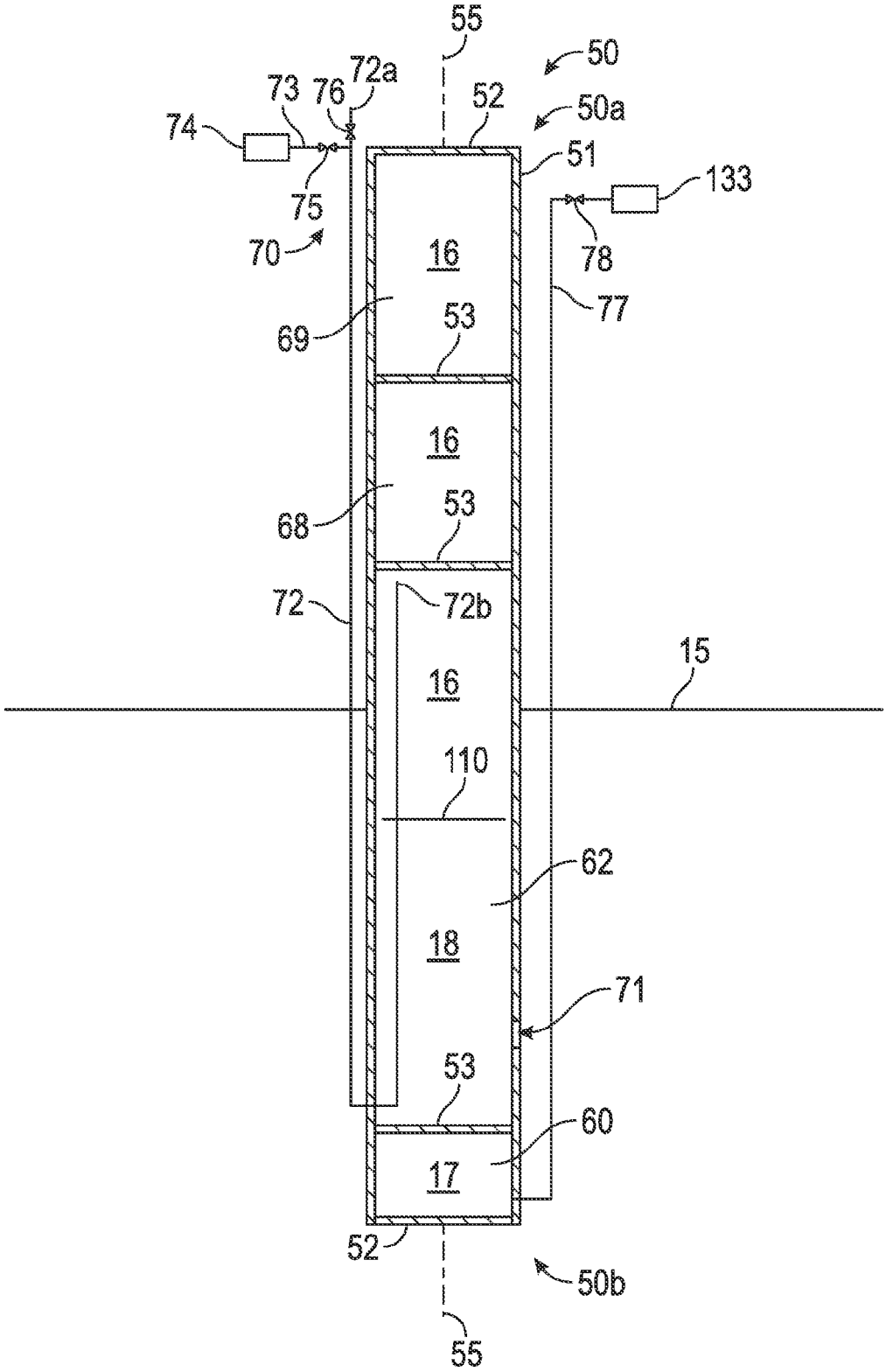
FIG. 6 is a schematic view of a single column of the second barge of FIGS. 1-5 and the associated ballast control system.

Referring now to FIG. 6, one column 50 is schematically shown, it being understood that each column 50 of barge 40 is configured the same. In this embodiment, column 50 comprises a radially outer tubular 51 extending between ends 50*a, b*, upper and lower end walls or caps 52 at ends 50*a, b*, respectively, and a plurality of axially spaced bulkheads 53 positioned within tubular 51 between ends 50*a, b*. End caps 52 and bulkheads 53 are each oriented perpendicular to axis 55. Together, tubular 51, end walls 52, and bulkheads 53 define a plurality of axially stacked compartments or cells within column 50—a fixed ballast chamber 60 at lower end 50*b*, a variable ballast or ballast adjustable chamber 62 axially adjacent chamber 60, and a pair of buoyant chambers 68, 69 axially disposed between upper end 50*a* and ballast adjustable chamber 62. Each chamber 60, 62, 68, 69 has a length $L_{60}$, $L_{62}$, $L_{68}$, $L_{69}$, respectively, measured axially between its axial ends. Depending on the particular installation location and desired buoyancy for column 46 (and second barge 40), each length $L_{60}$, $L_{62}$, $L_{68}$, $L_{69}$ may be varied and adjusted as appropriate.

End caps 52 close off ends 50*a, b* of column 50, thereby preventing fluid flow through ends 50*a, b* into chambers 60, 69, respectively. Bulkheads 53 close off the remaining ends of chambers 60, 62, 68, 69, thereby preventing fluid communication between adjacent chambers 60, 62, 68, 69. Thus, each chamber 60, 62, 68, 69 is isolated from the other chambers 60, 62, 68, 69 in column 50.

Chambers 68, 69 are filled with a gas 16 and sealed from the surrounding environment (e.g., water 15), and thus, provide buoyancy to column 50. Accordingly, chambers 68, 69 may also be referred to as buoyant chambers. In this embodiment, gas 16 is air, and thus, may also be referred to as air 16. Chamber 60 is at least partially filled with fixed ballast 17 (e.g., iron ore, magnetite or ferrite slurry, etc.) to facilitate the vertical orientation of column 50. During FPSO construction operations, the fixed ballast 17 in chamber 60 is generally permanent (i.e., remains in place). During FPSO construction operations, variable ballast 18 in chamber 62 can be controllably varied (i.e., increased or decreased), as desired, to vary the buoyancy of column 50 and second barge 40. In this embodiment, surrounding sea water 15 is used for variable ballast 18.

Although column 50 includes four chambers 60, 62, 68, 69 in this embodiment, in general, each column (e.g., each column 50) may include any suitable number of chambers. Preferably, at least one chamber is a ballast adjustable chamber and one chamber is an empty buoyant chamber (i.e., filled with air). Although end caps 52 and bulkheads 53 are described as providing fluid tight seals at the ends of chambers 60, 62, 68, 69, it should be appreciated that one or more end caps 52 and/or bulkheads 53 may include a closeable and sealable access port (e.g., man hole cover) that allows controlled access to one or more chambers 60, 62, 68, 69 for maintenance, repair, and/or service.

Columns 50 provide buoyancy to second barge 40, and thus, may be referred to as pontoons. In addition, columns 50 are ballast adjustable to control and vary the draft of barge 40. In this embodiment, a ballast control system 70 and a port 71 enable adjustment of the volume of variable ballast 18 (e.g., seawater 15) in chamber 62. More specifically, port 71 is an opening or hole in tubular 51 axially disposed between the upper and lower ends 50*a, b*. It should be appreciated that flow through port 71 is not controlled by a valve or other flow control device. Thus, port 71 permits the free flow of water 15, 18 into and out of chamber 62.

Referring still to FIG. 6, ballast control system 70 includes an air conduit 72, an air supply line 73, an air compressor or pump 74 connected to supply line 73, a first valve 75 along line 73 and a second valve 76 along conduit 72. Conduit 72 extends subsea into chamber 62, and has a venting end 72*a* above the surface of water 15 external to chamber 62 and an open end 72*b* disposed within chamber 62. Valve 76 controls the flow of air 16 through conduit 72 between ends 72*a, b*, and valve 75 controls the flow of air 16 from compressor 74 to chamber 62. Control system 70 allows the relative volumes of air 16 and water 15, 18 in chamber 62 to be controlled and varied, thereby enabling the buoyancy of chamber 62 and associated column 50 to be controlled and varied. In particular, with valve 76 open and valve 75 closed, air 16 is exhausted from chamber 62, and with valve 75 open and valve 76 closed, air 16 is pumped from compressor 74 into chamber 62. Thus, end 72*a* functions as an air outlet, whereas end 72*b* functions as both an air inlet and outlet. With valve 75 closed, air 16 cannot be pumped into chamber 62, and with valves 75, 76 closed, air 16 cannot be exhausted from chamber 62.

In this embodiment, open end 72*b* is disposed proximal the upper end of chamber 62 and port 71 is positioned proximal the lower end of chamber 62. This positioning of open end 72*b* enables air 16 to be exhausted from chamber 62 when column 50 is in a generally vertical, upright position. In particular, since buoyancy air 16 is less dense than water 15, 18, any air 16 in chamber 62 will naturally rise to the upper portion of chamber 62 above any water 15,18 in chamber 62 when column 50 is upright. Accordingly, positioning end 72*b* at or proximal the upper end of chamber 62 allows direct access to any air 16 therein. Further, since water 15,18 in chamber 62 will be disposed below any air 16 therein, positioning port 71 proximal the lower end of chamber 62 allows ingress and egress of water 15, 18 while limiting and/or preventing the loss of any air 16 through port 71. In general, air 16 will only exit chamber 62 through port 71 when chamber 62 is filled with air 16 from the upper end of chamber 62 to port 71. Positioning of port 71 proximal the lower end of chamber 62 also enables a sufficient volume of air 16 to be pumped into chamber 62. In particular, as the volume of air 16 in chamber 62 is increased, the interface 110 between water 15, 18 and the air 16 will move downward within chamber 62 as the increased volume of air 16 in chamber 62 displaces water 15, 18 in chamber 62, which is allowed to exit chamber through port 71. However, once the interface 110 of water 15, 18 and the air 16 reaches port 71, the volume of air 16 in chamber 62 cannot be increased further as any additional air 16 will simply exit chamber 62 through port 71. Thus, the closer port 71 to the lower end of chamber 62, the greater the volume of air 16 that can be pumped into chamber 62, and the further port 71 from the lower end of chamber 62, the lesser the volume of air 16 that can be pumped into chamber 62. Thus, the axial position of port 71 along chamber 62 is preferably selected to enable the maximum desired buoyancy for chamber 62.

In this embodiment, conduit 72 extends through tubular 51. However, in general, the conduit (e.g., conduit 72) and the port (e.g., port 71) may extend through other portions of the column (e.g., column 50). For example, the conduit may extend axially through the column (e.g., through cap 71 at upper end 50*a*) in route to the ballast adjustable chamber (e.g., chamber 62). Any passages (e.g., ports, etc.) extending through a bulkhead or cap are preferably completely sealed.

Furthermore, ballast control system 70 is preferably configured and controlled such that each column 50 is ballasted or de-ballasted simultaneously and contains about the same volume of air 16 and water 15, 18 at any given time to ensure second barge 40 remains stable with base 43 oriented substantially horizontal. This is particularly important when second barge 40 is supporting a load, such as module assembly 11.

Referring still to FIG. 6, fixed ballast chamber 60 is disposed at lower end 50*b* of column 50. In this embodiment, fixed ballast 17 (e.g., iron ore, magnetite or ferrite slurry, etc.) is pumped into chamber 60 with a ballast pump 133 and a ballast supply flowline or conduit 77 extending subsea to chamber 60. A valve 78 disposed along conduit 77 is opened to pump fixed ballast 17 into chamber 60. Otherwise, valve 78 is closed (e.g., prior to and after filling chamber 60 with fixed ballast 17). In other embodiments, the fixed ballast chamber (e.g., chamber 60) may simply include a port that allows water (e.g., water 15) to flood the fixed ballast chamber once it is submerged subsea.

Although ballast adjustable chamber 62 and fixed ballast chamber 60 are distinct and separate chambers in column 50 in this embodiment, in other embodiments, a separate fixed ballast chamber (e.g., chamber 60) may not be included. In such embodiments, the fixed ballast (e.g., fixed ballast 17) may simply be disposed in the lower end of the ballast adjustable chamber (e.g., chamber 62). The ballast control system (e.g., system 70) may be used to supply air (air 16), vent air, and supply fixed ballast (e.g., iron ore, magnetite or ferrite slurry, etc.) to the ballast adjustable chamber, or alternatively, a separate system may be used to supply the fixed ballast to the ballast adjustable chamber. It should be appreciated that the higher density fixed ballast will settle out and remain in the bottom of the ballast adjustable chamber, while water and air are moved into and out of the ballast adjustable chamber during ballasting and deballasting operations.

Referring again to FIG. 5, module support system 80 is coupled to columns 50 atop second barge 40. Support system 80 releasably engages and supports module assembly 11 during transport of module assembly 11 to vessel 90. In this embodiment, module support system 80 comprises a plurality of rigid support frames or members 81 mounted to upper ends 46*a* of columns 50 in each wall 44.

Referring again to FIGS. 1-4, vessel 90 floats at the surface of water 15 (e.g., offshore or nearshore) and includes a ship-shaped hull 91 and a deck 92 disposed atop hull 91. In general, vessel 90 can be an old oil tanker that is being refurbished and transformed into an FPSO, or a new vessel designed and constructed specifically as an FPSO.

Referring now to FIG. 1, module assembly 11 is loaded onto first barge 20 and transported aboard first barge 20 to second barge 40. In general, assembly 11 can be loaded onto first barge 20 by any suitable means. As previously described, the combined weight of multiple modules may exceed the load capacity of a conventional crane, and thus, a crane may not be able to lift and load module assembly 11 onto barge 20. However, other known means for loading large structures onto a vessel or barge may be employed. For example, assembly 11 can be disposed on rollers, skids, or guide rails onshore and rolled or slid onto barge 20.

Figure 2:
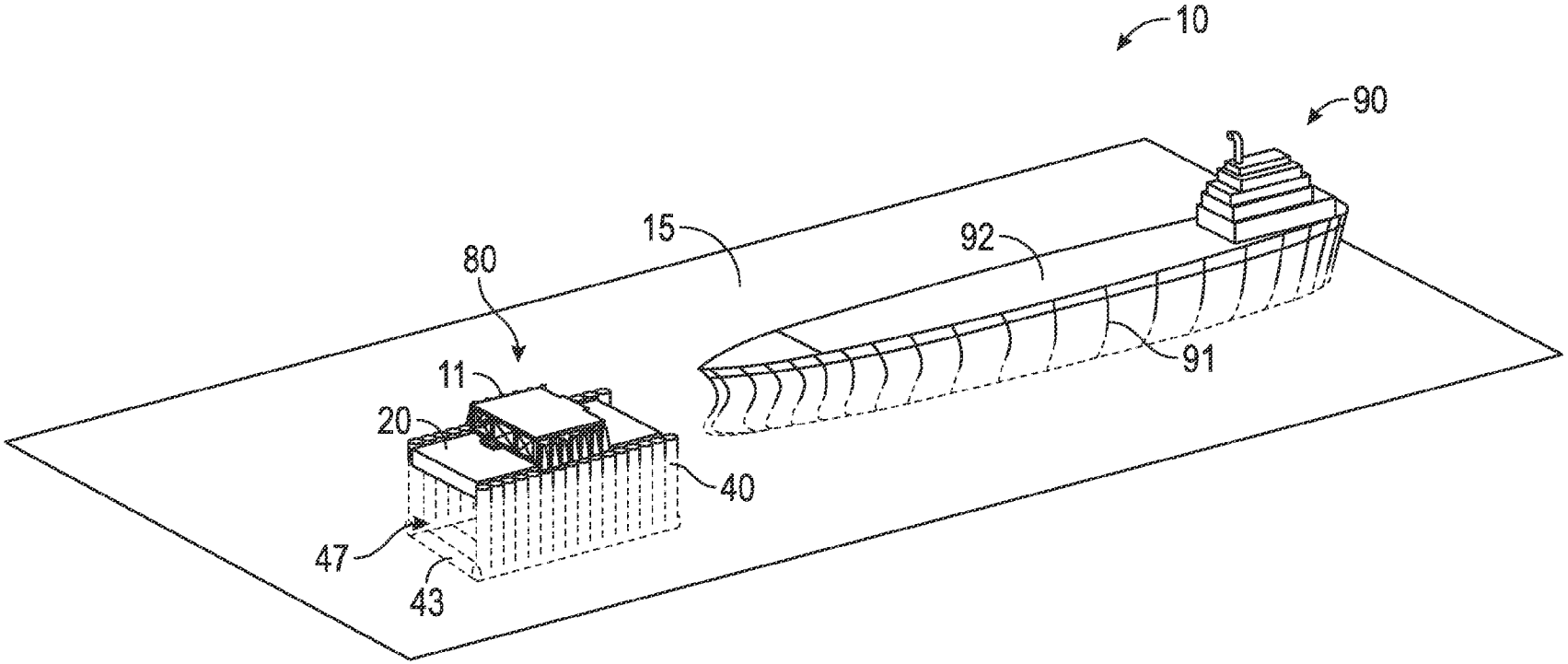

Referring now to FIGS. 1 and 2, using first barge 20, module assembly 11 is transported to second barge 40, advanced into bay 47, and horizontally aligned with support system 80. Prior to moving first barge 20 into bay 47, it may be necessary to ballast second barge 40 to ensure first barge 20 can navigate into bay 47 without colliding with base 43. Once first barge 20 is disposed in bay 47, second barge 40 is ballasted/deballasted as necessary to vertically align support system 80 with module assembly 11, and then support members 81 are secured to module assembly 11. In general, module assembly 11 can be secured to support members 81 by any suitable means known in the art. In this embodiment, module assembly 11 is secured to support members 81 with a plurality of bolts. Next, second barge 40 is deballasted to lift module assembly 11 from first barge 20. With module assembly 11 removed from first barge 20, first barge 20 exits bay 47.

Figure 3:
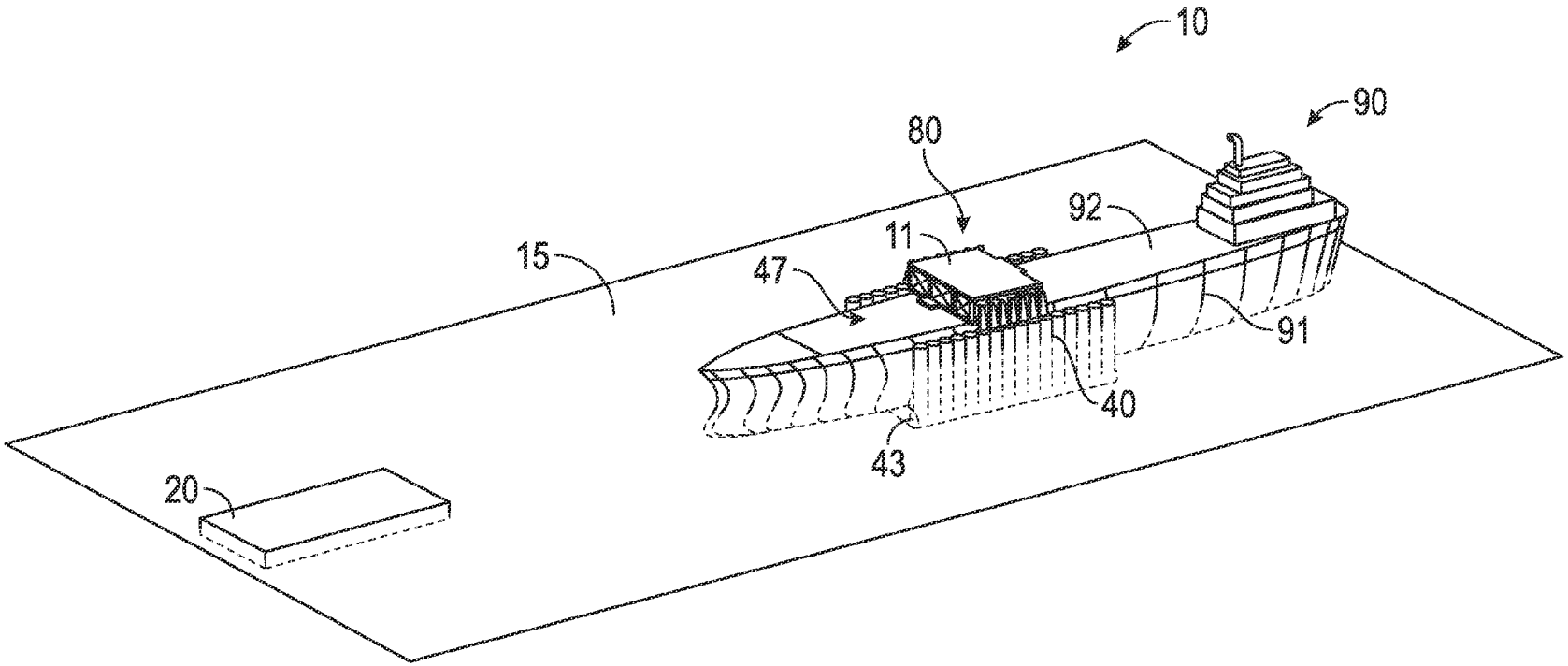

Next, as shown in FIGS. 2 and 3, module assembly 11 is transported aboard second barge 40 to vessel 90, and vessel 90 is ballasted and/or second barge 40 is deballasted to ensure module assembly 11 is disposed at a height above deck 92. Vessel 90 is then positioned in bay 47 below module assembly 11 and above base 43. In particular, module assembly 11 is preferably positioned directly above the desired landing and installation site on deck 92.

Figure 4:
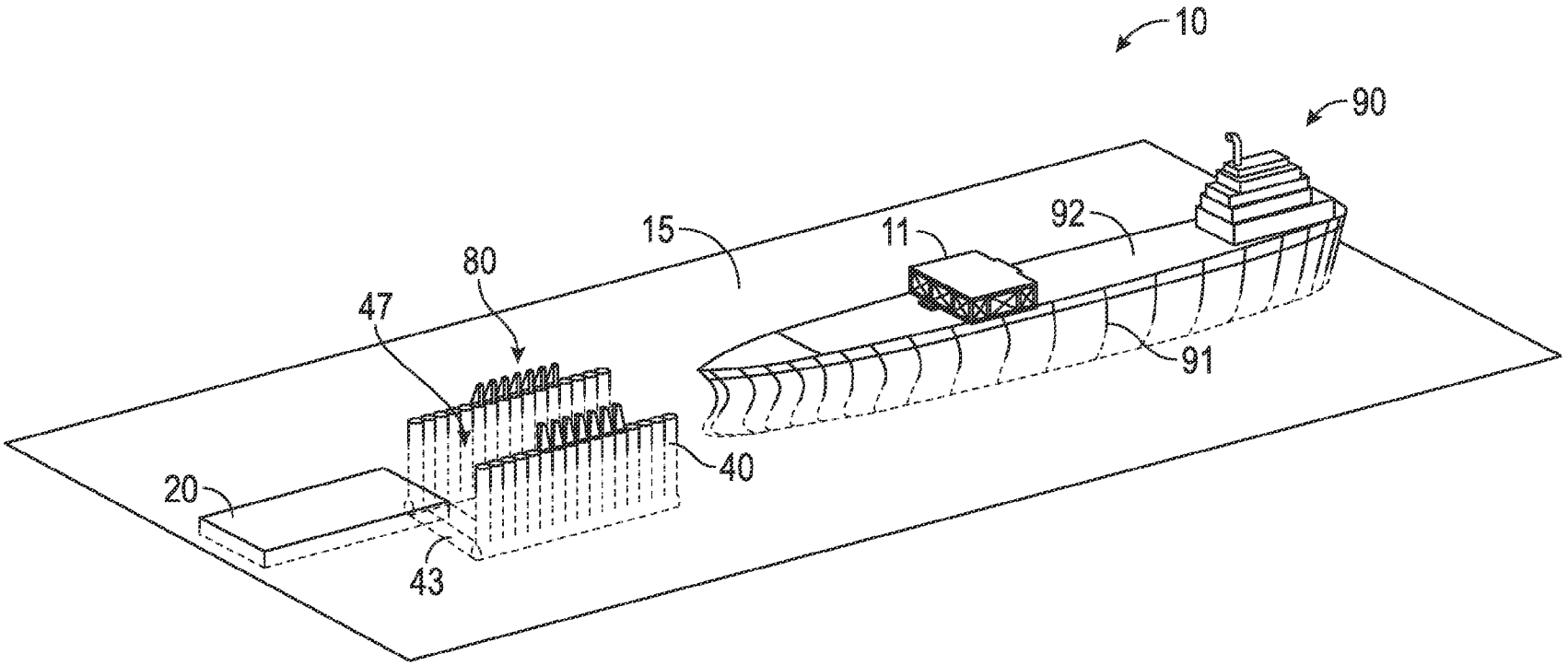

Moving now to FIGS. 3 and 4, vessel 90 is de-ballasted and/or barge 40 is ballasted to position module assembly 11 on deck 92. Next, module assembly 11 is de-coupled from module support system 80 and installed on deck 92. Once module assembly 11 is seated on deck 92 and disconnected from support system 80, vessel 90 is moved out of bay 47. In this manner, pre-assembled and pre-integrated module assembly 11, which may be too heavy to load with cranes, is loaded and installed on deck 92. One or more additional pre-integrated module assemblies may be loaded and installed on deck 92 in the same manner.

It should be appreciated that the depth of water 15 limits the maximum draft depth to which second barge 40 and vessel 90 may be ballasted. If the desired draft depth of second barge 40 or vessel 90 exceeds the depth of water 15, this process may be performed at a different location (e.g., further offshore) where the depth of water 15 is sufficient. During the deployment and installation of assembly 11, first barge 20 is positioned in bay 47 of second barge 40, and subsequently, vessel 90 is positioned in bay 47 of second barge 40. In general, the positioning of first barge 20 within bay 47 requires the movement of first barge 20 relative to second barge 40 and the positioning of vessel 90 within bay 47 requires the movement of vessel 90 relative to second barge 40. In general, the relative movement of first barge 20 and second barge 40 may be accomplished by moving first barge 20 and/or second barge 40. Likewise, the relative movement of second barge 40 relative to vessel 90 may be accomplished by moving second barge 40 and/or vessel 90.

Referring now to FIGS. 7-12, another embodiment of system 100 for constructing an FPSO is shown. System 100 is similar to system 10 previously described. Namely, system 100 includes module assembly 11, first barge 20, second barge 40, and vessel 90, each as previously described. However, in this embodiment, module support system 80 disposed atop second barge 40 is replaced with a different module support system 180. Similar to system 10 previously described and as will be described in more detail below, first barge 20 transports module assembly 11 from the shore to second barge 40, and second barge 40 transports module assembly 11 to vessel 90 and loads module assembly 11 onto vessel 90 for installation thereon to construct an FPSO.

Figure 13:
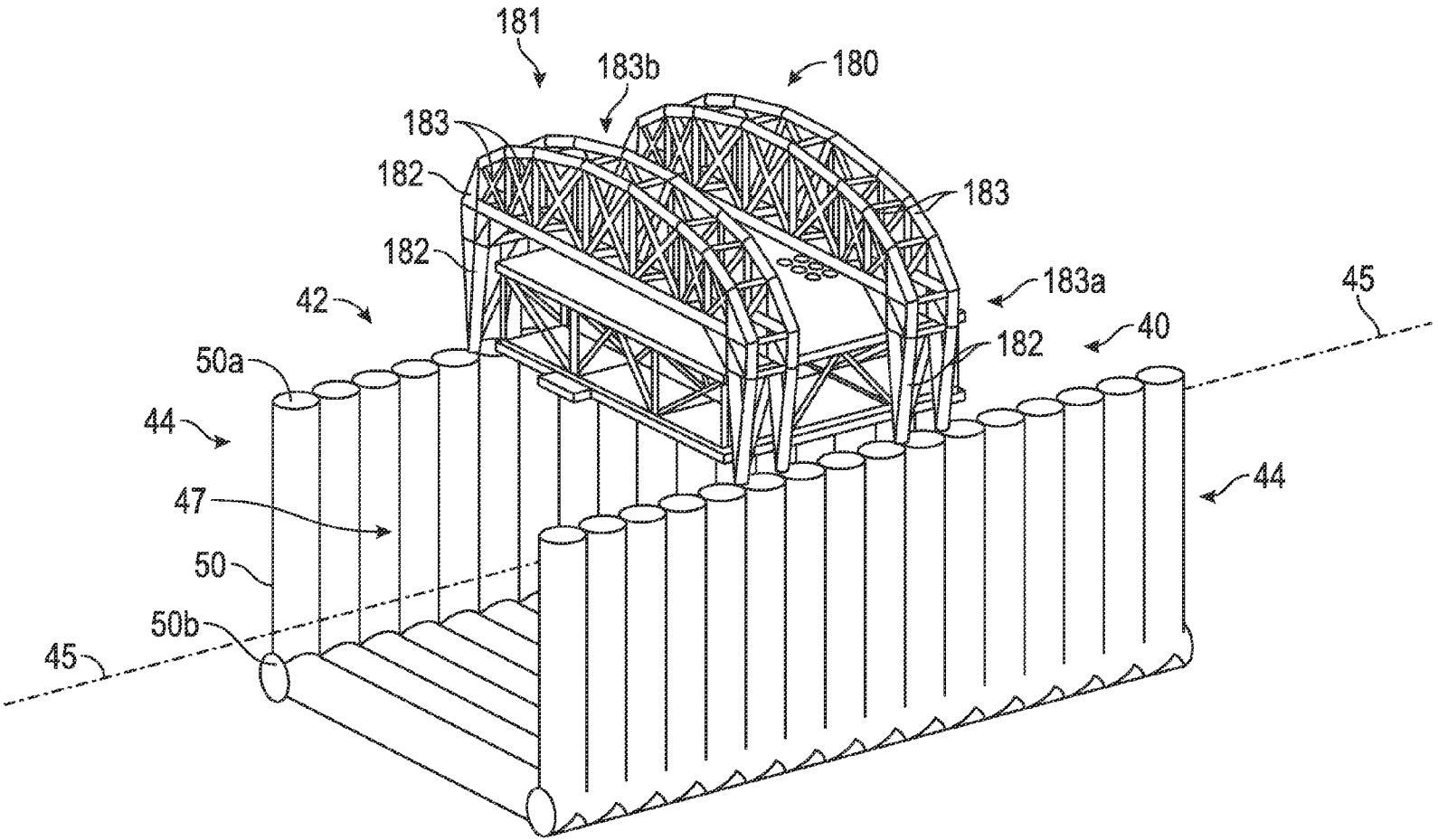
FIG. 13 is an enlarged view of the second barge and module assembly of FIGS. 7-12.

Referring briefly to FIG. 13, in this embodiment, module support system 180 comprises a bridge support assembly 181 extending across the top 42 of second barge 40. Bridge support assembly 181 comprises a plurality of generally vertical lower support frames or members 182 and a plurality of generally horizontal upper support trusses or frames 183. Lower members 182 are coupled to and extend upward from upper ends 50*a* of select columns 50 in each wall 44. In this embodiment, two lower support members 182 are mounted to each wall 44. Each upper support frame 183 has a first end 183*a* connected to one lower support member 182 and a second end 183*b* connected to one lower support member 182 on the opposite side of bay 47. Thus, upper members 183 span bay 47 generally perpendicular to axis 45 in top view.

A plurality of cables or rods (not shown) are suspended from and hang down from upper frames 183. As will be described in more detail below, module assembly 11 is suspended from the cables or rods, and thus, bridge support assembly 181 and such cables or rods are sized and configured to support the entire weight of module assembly 11.

Figure 7:
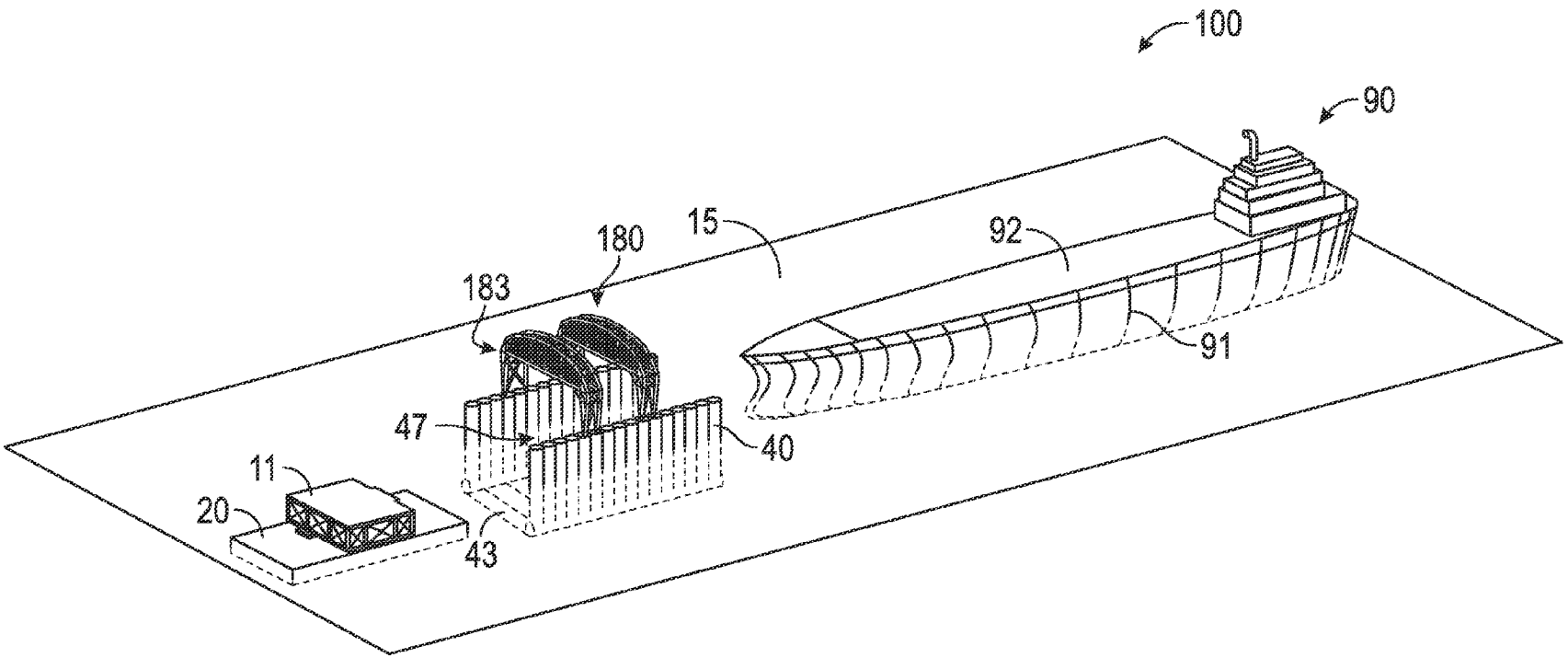
FIGS. 7-12 are sequential perspective views illustrating an embodiment of a method for installing a pre-integrated module assembly onto an FPSO hull in accordance with the principles described herein.

Referring now to FIG. 7, module assembly 11 is loaded onto first barge 20 and transported aboard first barge 20 to second barge 40. In general, assembly 11 may be loaded onto first barge 20 by any suitable means. As previously described, the combined weight of multiple modules may exceed the load capacity of a conventional crane, and thus, a crane may not be able to load assembly 11 onto first barge 20. However, as previously described, other known means for loading large structures onto a vessel or barge may be employed.

Figure 8:
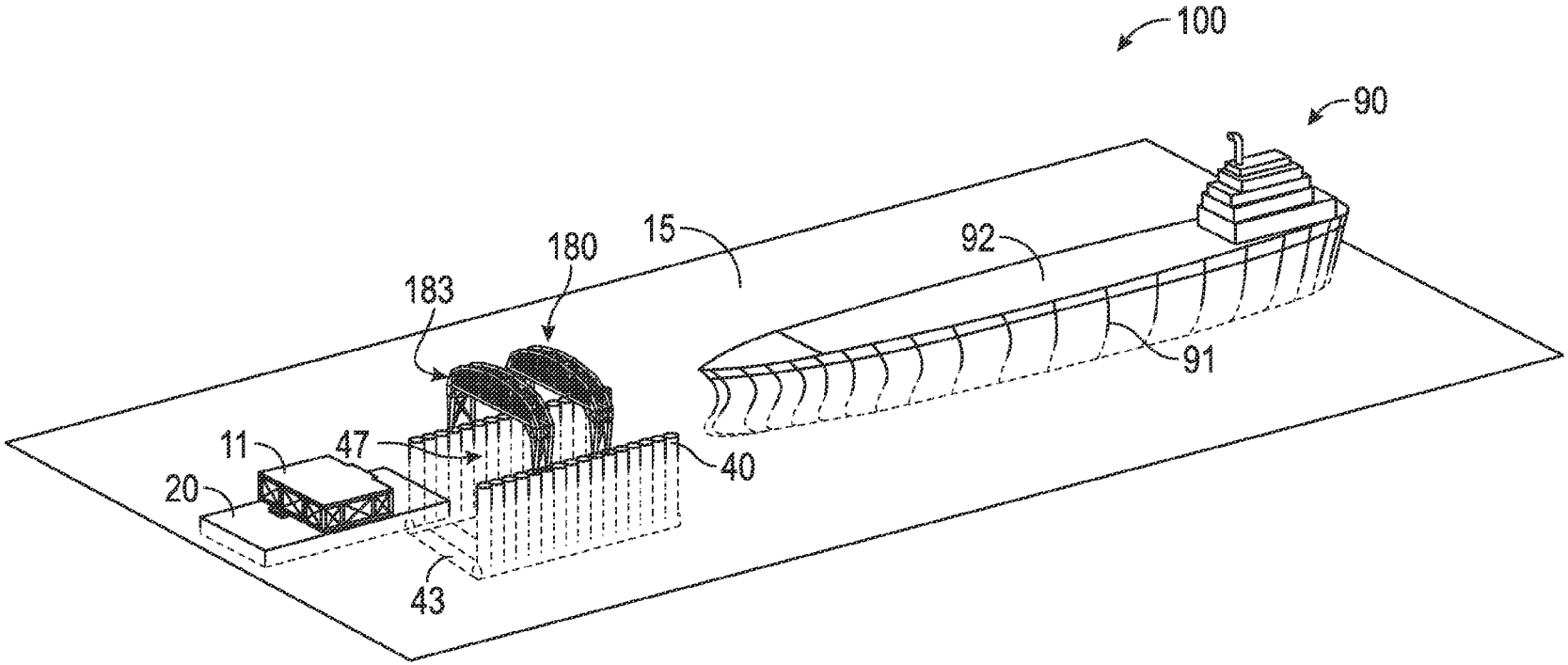
Figure 9:
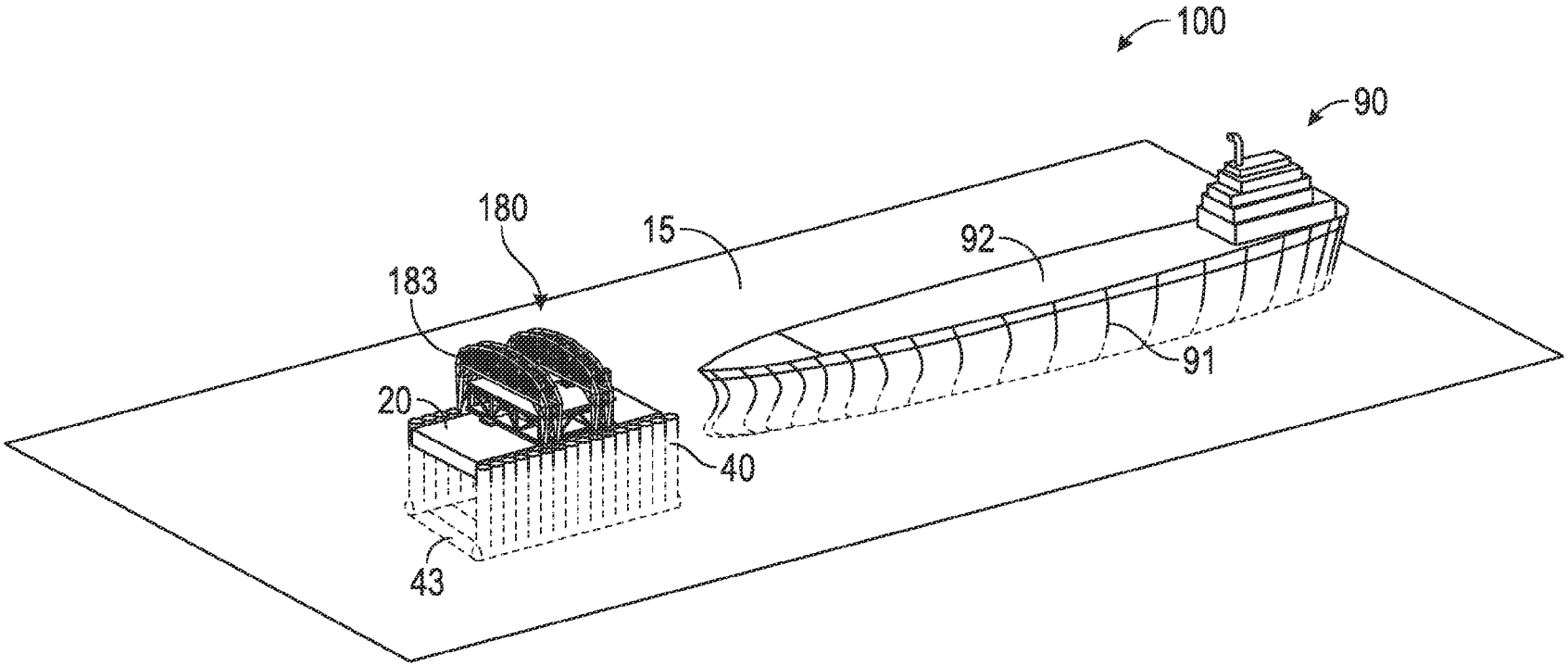

Referring now to FIGS. 8 and 9, using first barge 20, module assembly 11 is transported to second barge 40, advanced into bay 47, and positioned below support system 180. Prior to moving first barge 20 into bay 47, it may be necessary to ballast or deballast second barge 40 to ensure first barge 20 can navigate into bay 47 without colliding with base 43 or support system 180. Once first barge 20 is disposed in bay 47 with module assembly 11 positioned below upper support frames 183, the cables or rods extending from upper support frames 183 are connected to module assembly 11. Second barge 40 may be ballasted and/or de-ballasted as necessary to adjust the position of module support assembly 181 relative to module assembly 11 to enable connection of the cables or rods. Next, second barge 40 is deballasted to lift module assembly 11 from first barge 20. With module assembly 11 removed from first barge 20, first barge 20 exits bay 47.

Figure 10:
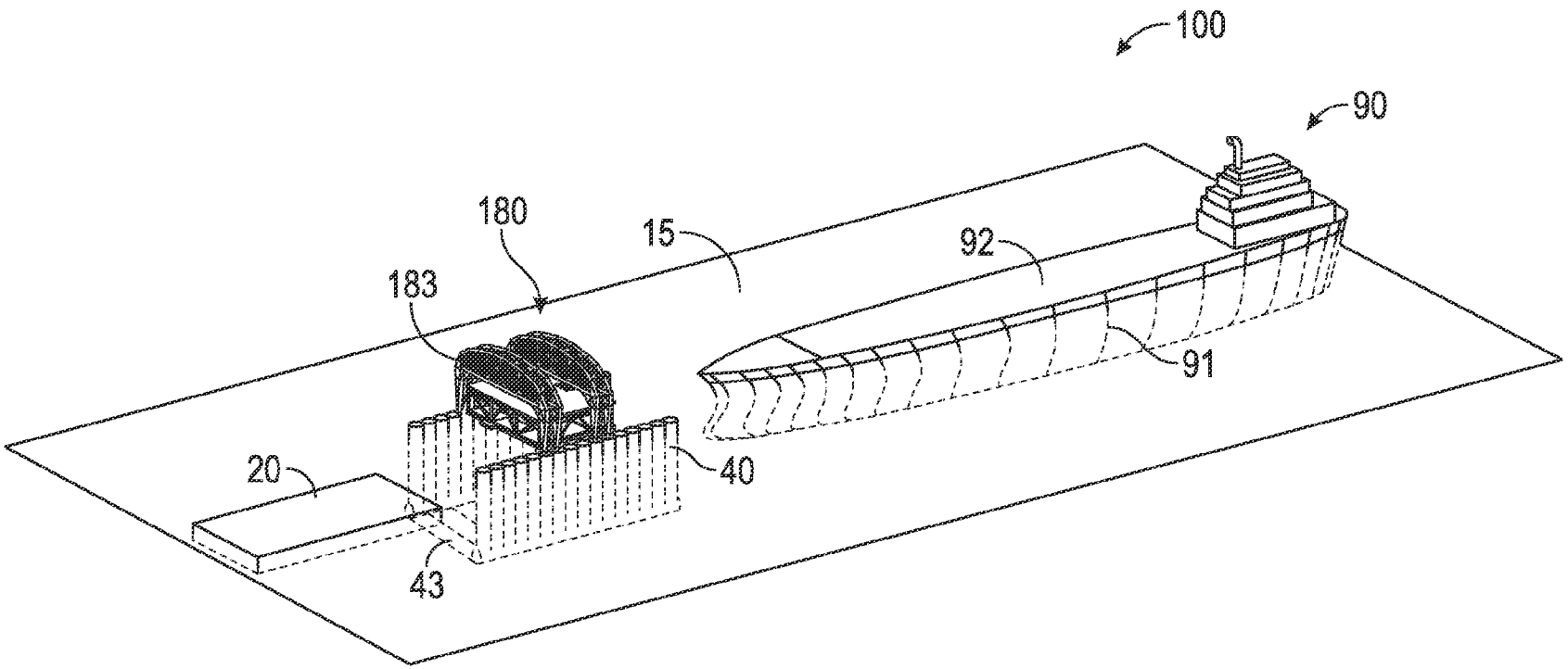
Figure 11:
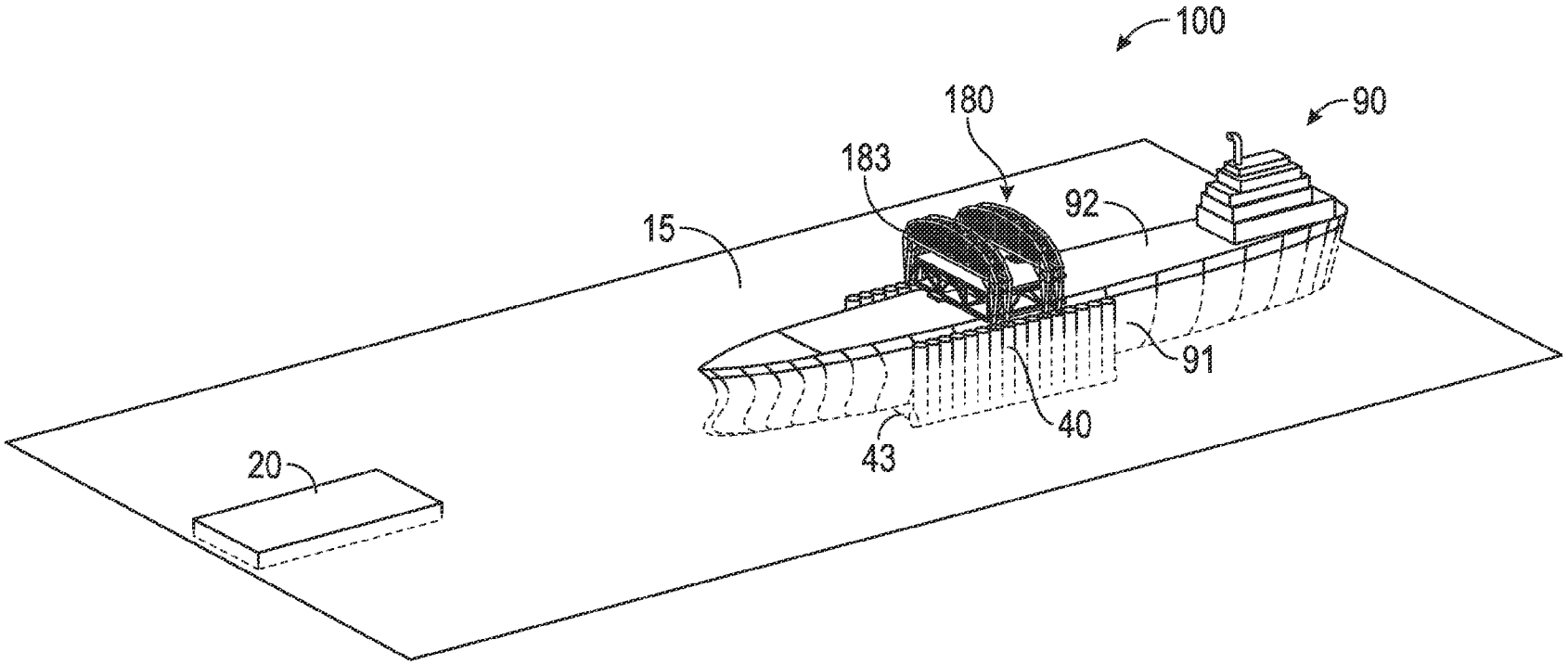

Next, as shown in FIGS. 10 and 11, module assembly 11 is transported aboard second barge 40 to vessel 90, and vessel 90 is ballasted and/or second barge 40 is deballasted to ensure module assembly 11 is disposed at a height above deck 92. Vessel 90 is then positioned in bay 47 below module assembly 11 and above base 43. In particular, module assembly 11 is preferably positioned directly above the desired landing and installation site on deck 92.

Figure 12:
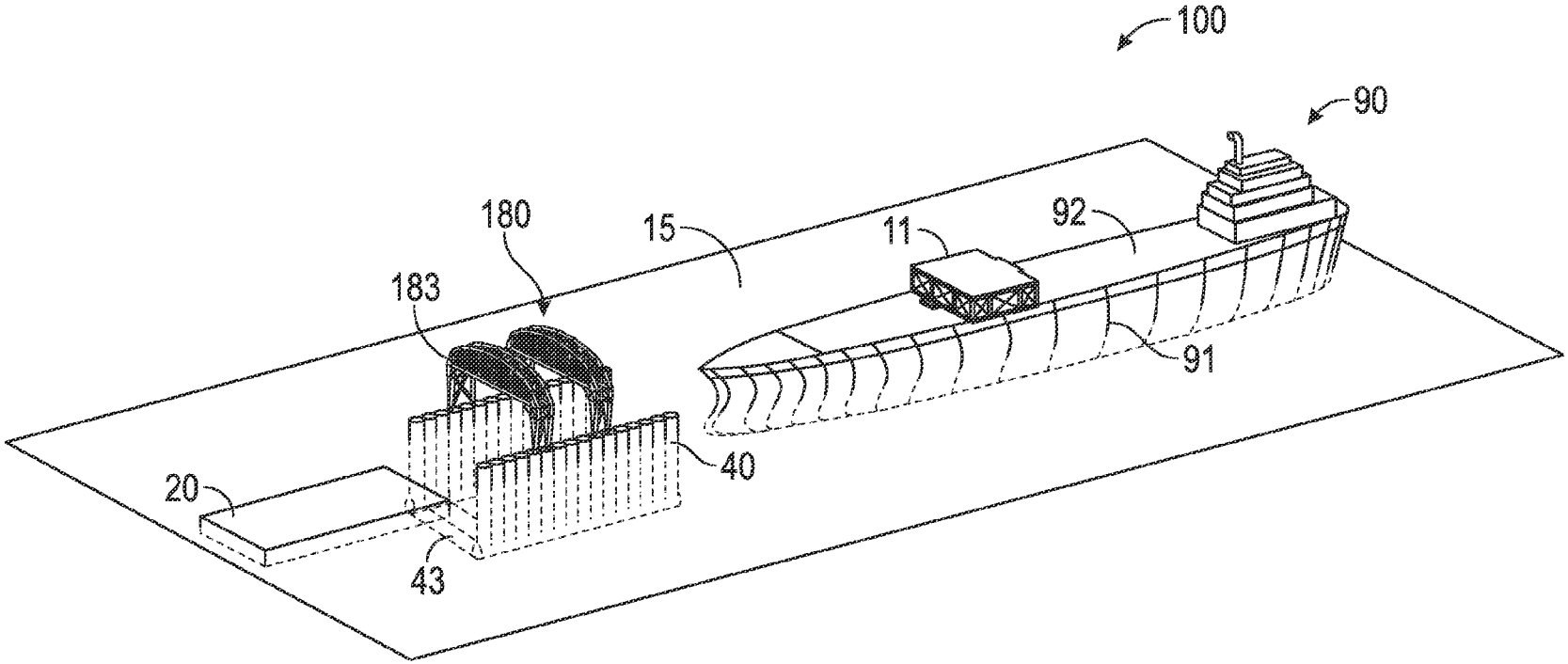

Moving now to FIGS. 11 and 12, vessel 90 is de-ballasted and/or barge 40 is ballasted to position module assembly 11 on deck 92. Next, module assembly 11 is de-coupled from module support system 180 and installed on deck 92. Once module assembly 11 is seated on deck 92 and disconnected from support system 180, vessel 90 is moved out of bay 47. In this manner, pre-assembled and pre-integrated module assembly 11, which may be too heavy to load with cranes, is loaded and installed on deck 92. One or more additional pre-integrated module assemblies may be loaded and installed on deck 92 in the same manner.

As previously described, the depth of water 15 limits the maximum draft depth to which barge 40 and vessel 90 may be ballasted. If the desired draft depth of barge 40 or vessel 90 exceeds the depth of water 11, this process may be performed at a different location (e.g., further offshore) where the depth of water 15 is sufficient. Also, during the deployment and installation of assembly 11, first barge 20 is positioned in bay 47 of second barge 40, and subsequently, vessel 90 is positioned in bay 47 of second barge 40. In general, the positioning of first barge 20 within bay 47 requires the movement of first barge 20 relative to second barge 40 and the positioning of vessel 90 within bay 47 requires the movement of vessel 90 relative to second barge 40. In general, the relative movement of first barge 20 and second barge 40 may be accomplished by moving first barge 20 and/or second barge 40. Likewise, the relative movement of second barge 40 relative to vessel 90 may be accomplished by moving second barge 40 and/or vessel 90.

Figure 14:
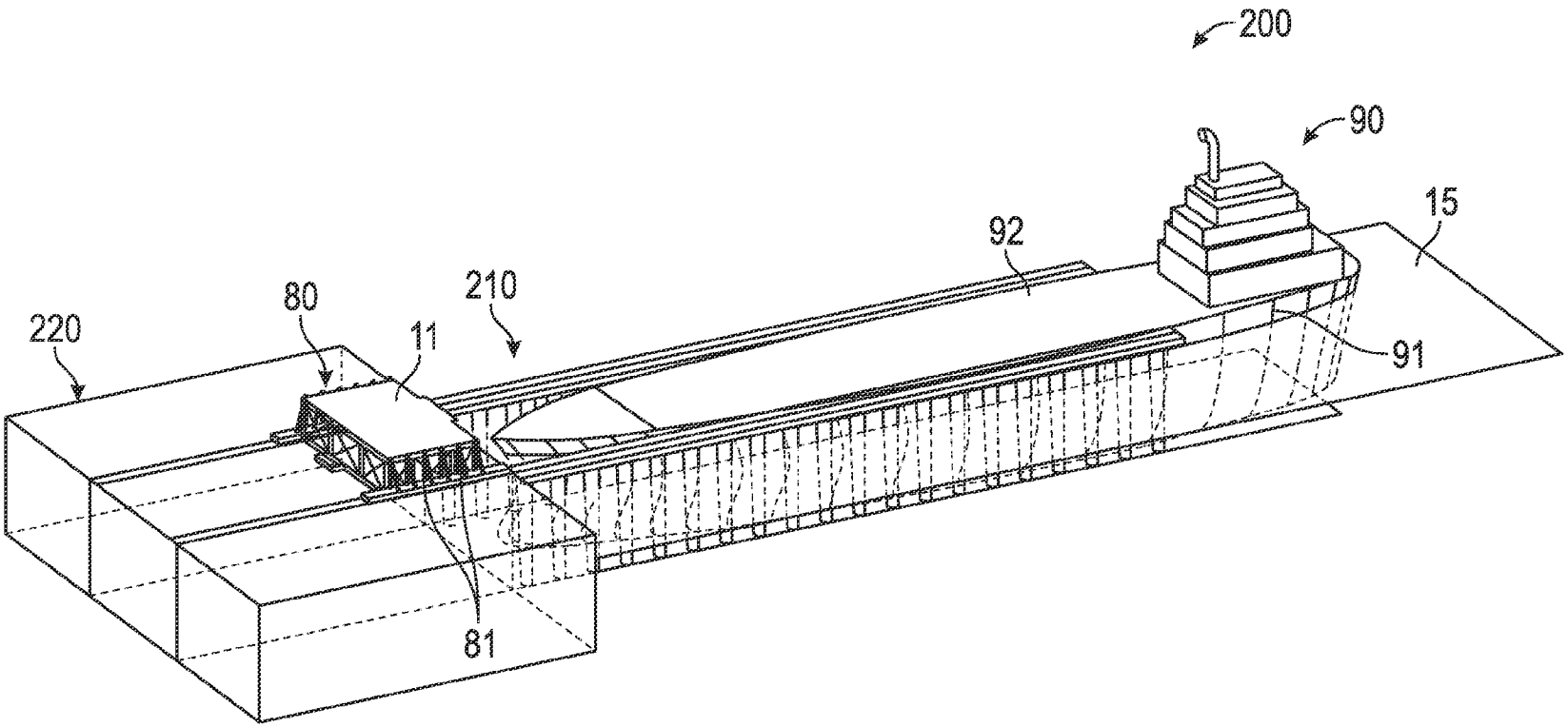
FIG. 14-16 are sequential perspective views illustrating an embodiment of a method for installing a pre-integrated module assembly onto an FPSO hull in accordance with the principles described herein.
Figure 15:
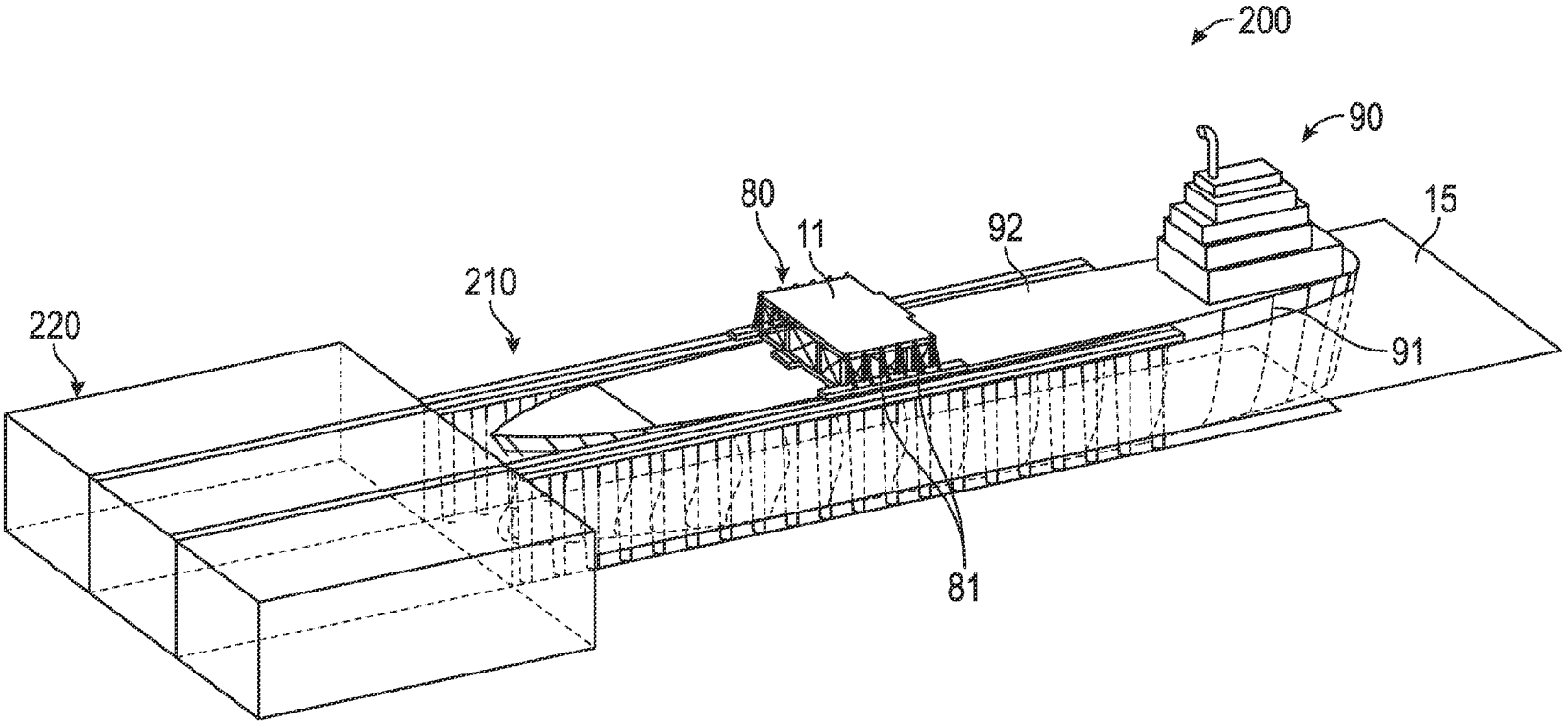
Figure 16:
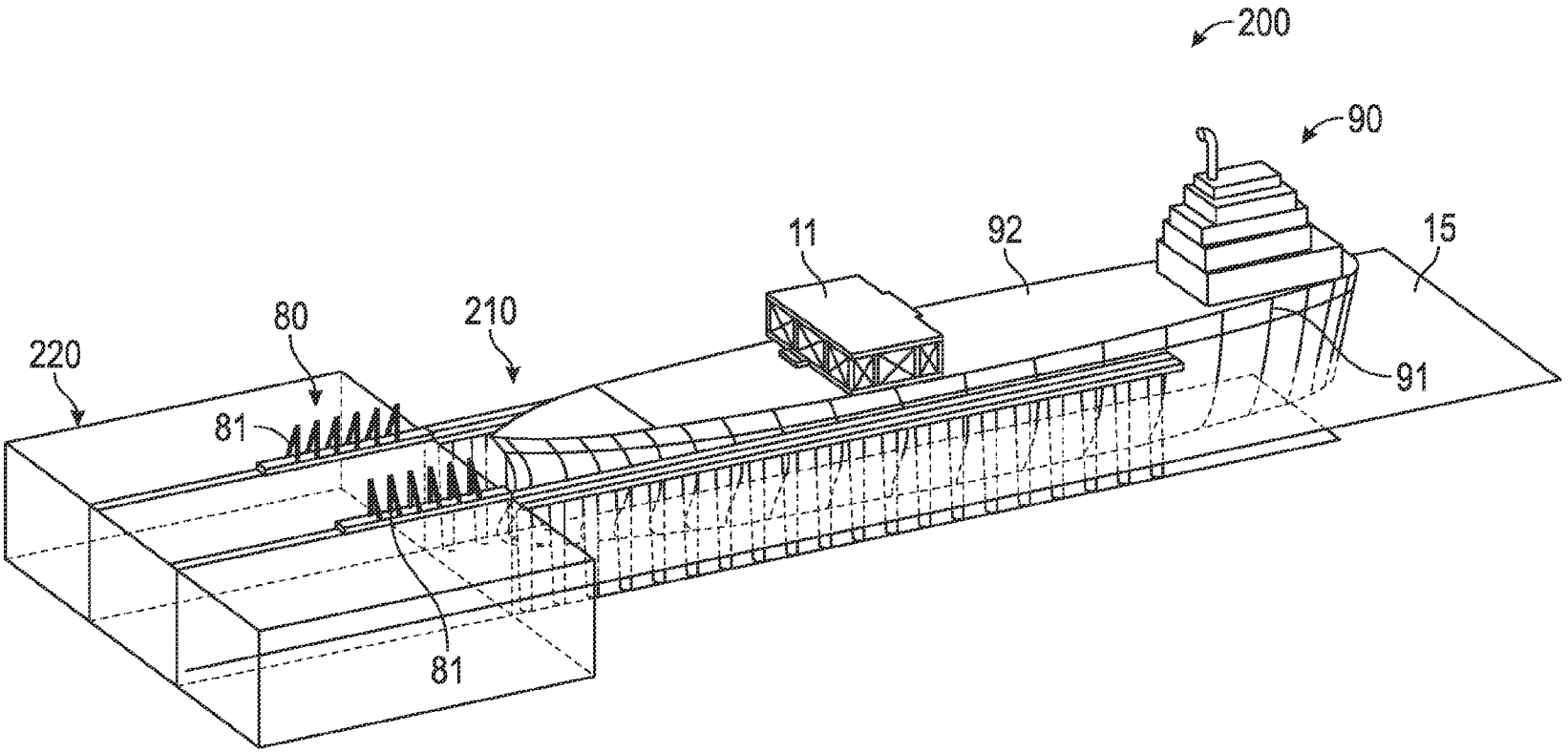

Referring now to FIGS. 14-16, another embodiment of a system 200 for constructing an FPSO is shown. In this embodiment, system 200 includes a module assembly 11, a module support system 80, and a vessel 90, each as previously described. In addition, in this embodiment, system 200 includes a rail assembly 210 and an on-shore integration area 220. As will be described in more detail below, module assembly 11 is transported from integration area 220 to vessel 90 by way of rail assembly 210, and is installed on the deck 92 of vessel 90 in order to construct an FPSO.

Figure 17:
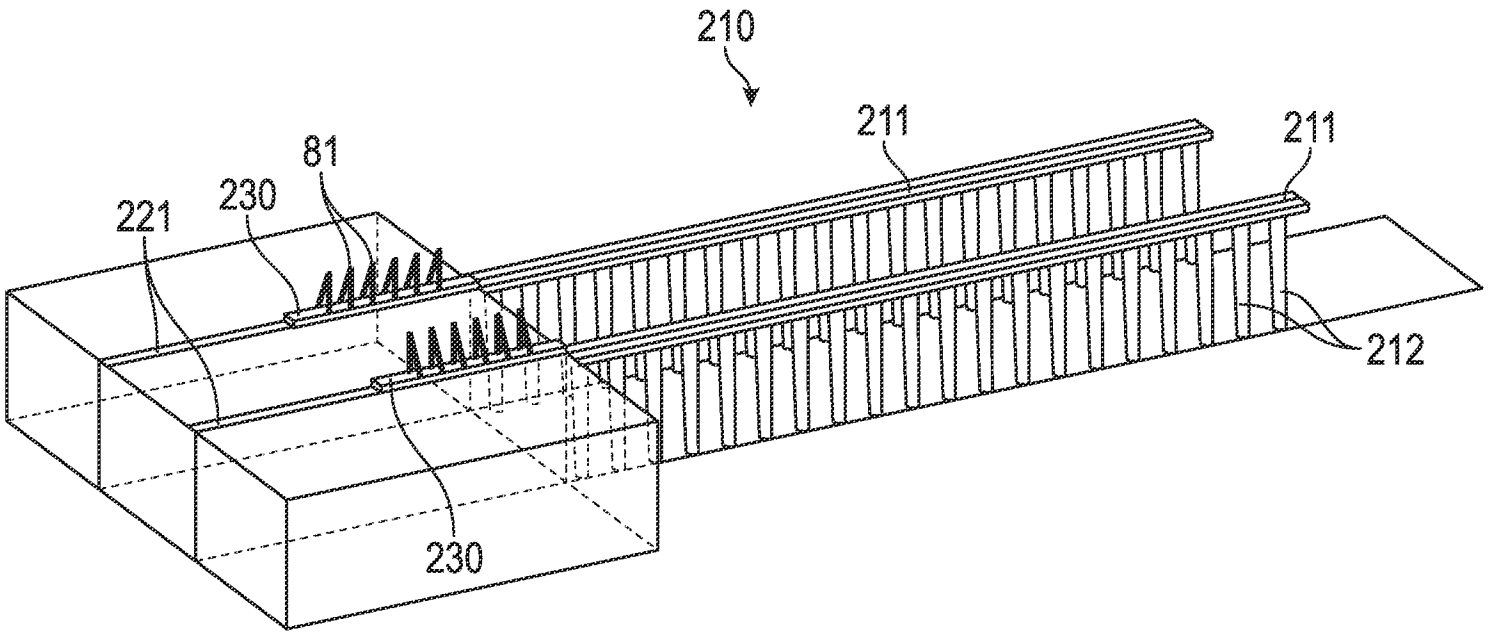
FIG. 17 is an enlarged view of the integration area and rail assembly of FIGS. 14-16.

Referring now to FIG. 17, rail assembly 210 comprises a pair of elongate, spaced-apart, parallel skidways or rails 211, each supported above the surface of water 15 with a plurality of support members 212. In this embodiment, support members 212 are vertical piles that penetrate the sea floor and extend vertically upward above the surface of water 15. Rails 211 and corresponding support members 212 are spaced apart a distance greater than the width of vessel 90 such that vessel 90 can be positioned therebetween.

Each rail 211 is aligned with and abuts end-to-end with a corresponding skidway or rail 221 extending along integration area 220. In this embodiment, rails 221, 211 are coupled together end-to-end. A carriage 230 is moveably coupled to each set of aligned rails 221, 211. Thus, each carriage 230 may be moved back-and-forth along its corresponding rails 211, 221. A module support system 80 as previously described is provided on carriages 230. In particular, a plurality of support members 81 are mounted to the top of each carriage 230.

Referring now to FIG. 14, carriages 230 are positioned on rails 221 in integration area 220. Module assembly 11 is then positioned between support members 81 mounted to carriages 230, and secured to support members 81 (e.g., with bolts). As previously described, assembly 11 can be positioned between support members 81 by any suitable means.

Since the combined weight of multiple modules may exceed the load capacity of a conventional crane, a crane may not be able to load assembly 11 onto integration area 220. However, other known means for loading and moving large structures may be employed. In addition, vessel 90 is positioned between rails 211.

Referring now to FIGS. 14 and 15, vessel 90 is positioned between rails 211 and ballasted, as necessary, to ensure deck 92 is disposed at a height below module assembly 11. Next, module assembly 11 is transported from integration area 220 over deck 92 via carriages 230, which move along rails 221, 211. Carriages 230 are advanced along rails 211 until module assembly 11 is positioned directly above the desired landing and installation site on deck 92.

Moving now to FIGS. 15 and 16, vessel 90 is de-ballasted to position module assembly 11 on deck 92, and then, module assembly 11 is de-coupled from support members 81 and installed on deck 92. Once disconnected from assembly 11, carriages 230 may be moved back to integration area 220 via rails 211, 221. In this manner, pre-assembled and pre-integrated module assembly 11, which may be too heavy to load with cranes, is loaded and installed on deck 92. One or more additional pre-assembled and pre-integrated module assemblies may be loaded and installed on deck 92 in the same manner.

As previously described, in this embodiment, module support system 80 is employed to support module assembly 11 as it is positioned over vessel 90. However, in other embodiments, module support system 80 can be replaced with module support system 180 previously described.

Referring now to FIGS. 18-21, another embodiment of a system 300 for constructing an FPSO is shown. System 300 is similar to system 200 previously described. Namely, system 300 includes a module assembly 11, an integration area 220, a module support system 80, and a vessel 90, each as previously described. However, in this embodiment, system 300 includes a floating rail assembly 310 instead of pile supported rail system assembly 210. As will be described in more detail below, module assembly 11 is transported from integration area 220 by way of floating rail assembly 310, and is installed on the deck 92 of vessel 90 in order to construct an FPSO.

Figure 18:
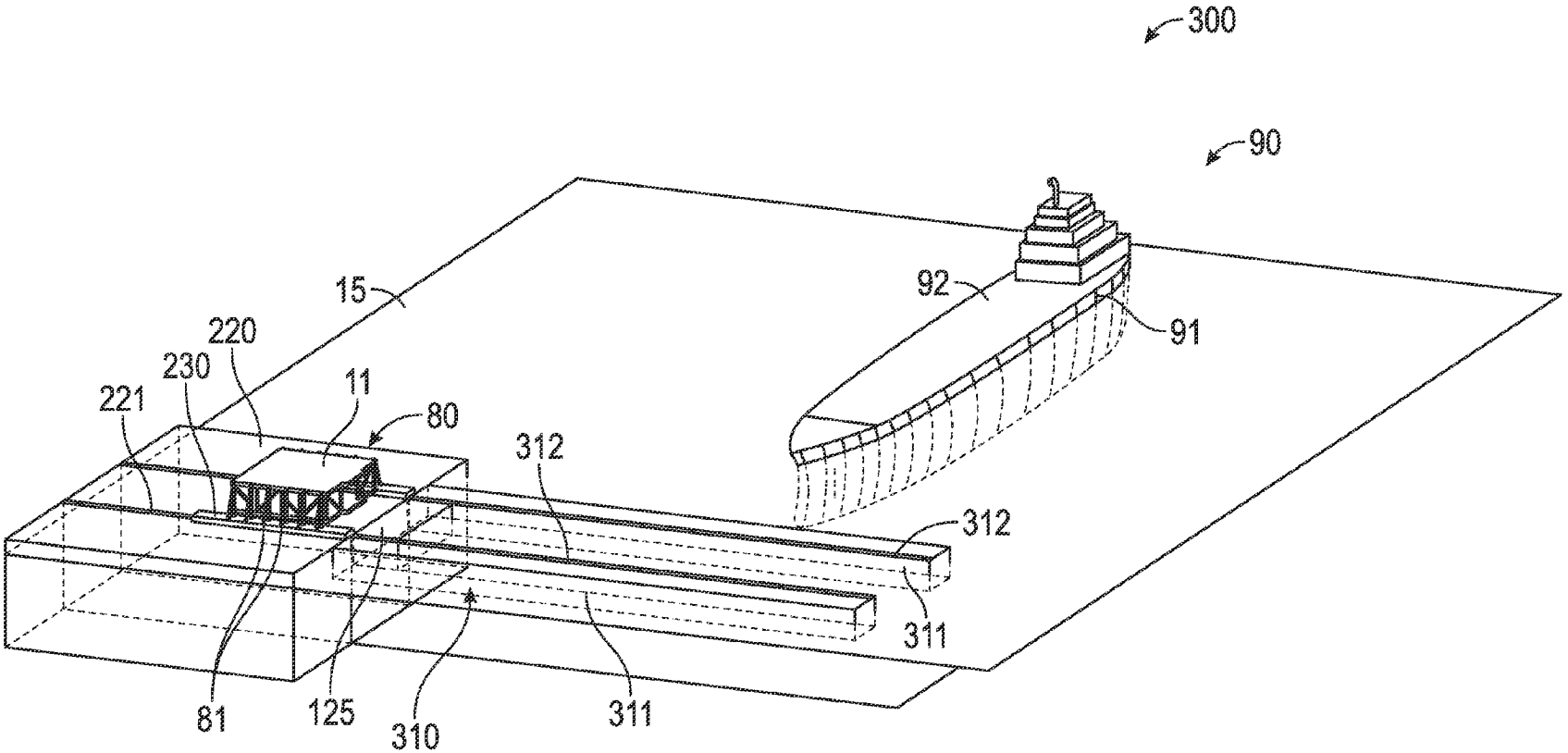
FIG. 18-21 are sequential perspective view illustrating an embodiment of a method for installing a pre-integrated module assembly onto an FPSO hull in accordance with the principles described herein.

Referring to FIG. 18, in this embodiment, rail assembly 310 comprises a pair of elongate, spaced-apart, parallel pontoons 311 and a pair of elongate parallel skidways or rails 312. Each rail 312 is mounted to and supported by one pontoon 311. As will be described in more detail below, pontoons 311 are ballast adjustable, and thus, may be controllably ballasted and de-ballasted to vary and control the vertical position of rails 312 relative to the surface of water 15.

Figure 22:
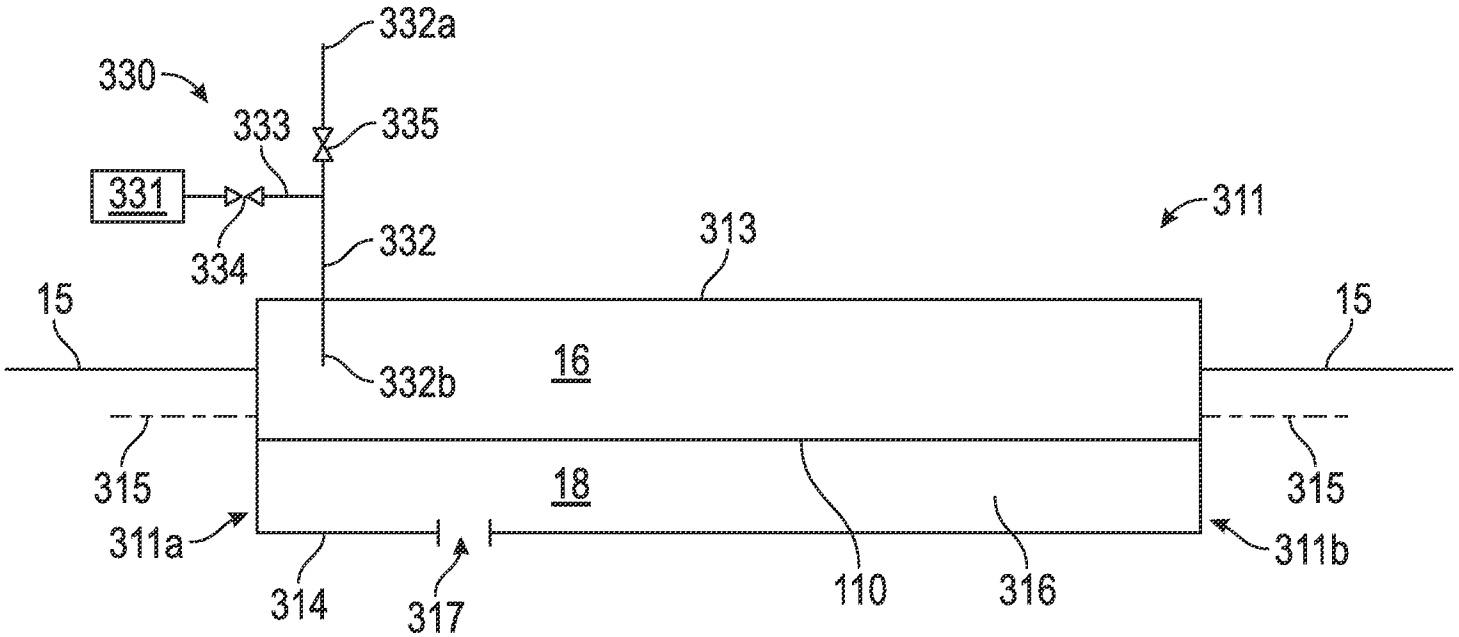
FIG. 22 is a schematic view of a single pontoon of the pontoon rail assembly of FIGS. 18-21 and the associated ballast control system.

Referring now to FIG. 22, one pontoon 311 is shown, it being understood that each pontoon 311 is configured the same. Each pontoon 311 has a central or longitudinal axis 315, a top side 313 disposed above the water 15, a bottom side 314 disposed below the water 15, a first end 311*a*, and a second end 311*b* opposite first end 311*a*. In addition, each pontoon 311 is horizontally oriented such that the surface of the water 15 runs substantially parallel to axis 315. Ends 311*a, b* are closed or capped, thereby defining an internal variable ballast chamber 316 within pontoon 311. An open port 317 positioned along the bottom side 314 of pontoon 311 and allows the free flow of water into and out of chamber 316.

A ballast control system 330 controls the relative volumes of air 16 and water 15, 18 within pontoon 311. Specifically, ballast control system 330 comprises a pump or compressor 331, a conduit 332, an air supply line 333, a first valve 334 along air supply line 333, a second valve 335 along conduit 332. Conduit 332 has a first open end 332*a* disposed outside of pontoon 311 and a second open end 332*b* disposed within chamber 316. In order to ballast pontoon 311, valve 335 is opened and valve 334 is closed thereby allowing air 16 to escape out of the first open end 332*a*. As air 16 escapes out of first open end 332*a*, water 15, 18 flows through port 317 into chamber 316. Alternatively, in order to de-ballast pontoon 311, valve 335 is closed and valve 334 is opened, thereby allowing compressor 331 to pump air 16 through line 333 and open valve 334 and into conduit 332. As air 16 is pumped into chamber 316 via conduit 332, water 15, 18 is forced out of port 317. Pontoons 311 are preferably ballasted and de-ballasted at the same rate and to the same degree to maintain pontoons 311 at substantially the same draft relative to the surface of water 15.

Referring again to FIG. 18, rails 312 and associated pontoons 311 are spaced apart a distance greater than the width of vessel 90 such that vessel 90 can be moved therebetween. Thus, pontoons 311 define a bay sized to receive vessel 90. In this embodiment, rails 312 are held in a fixed spaced-apart relationship by a spacing member 125 extending perpendicularly between ends 311*a* of pontoons 311.

Rail assembly 310 is releasably coupled to integration area 220. In particular, pontoons 311 are tied to integration area 220 with mooring lines as is conventionally employed for load-out operations. When rail assembly 310 is coupled to integration area 220, each rail 312 is aligned with and abuts end-to-end with a corresponding rail 221 on integration area 220. In this embodiment, rails 312, 221 are releasably coupled end-to-end. One carriage 230 as previously described is moveably coupled to each set of aligned rails 221, 312. Thus, when assembly 310 is coupled to integration area 220, each carriage 230 may be moved back-and-forth along its corresponding rails 221, 312. In this embodiment, module support system 80 as previously described is mounted to carriages 230.

Referring still to FIG. 18, carriages 230 are positioned on rails 221 in integration area 220. Module assembly 11 is then positioned between support members 81 mounted to carriages 230, and secured to support members 81 (e.g., with bolts). As previously described, assembly 11 can be positioned between support members 81 by any suitable means. Since the combined weight of multiple modules may exceed the load capacity of a conventional crane, a crane may not be able to load assembly 11 onto integration area 220. However, other known means for loading and moving large structures may be employed.

Figure 19:
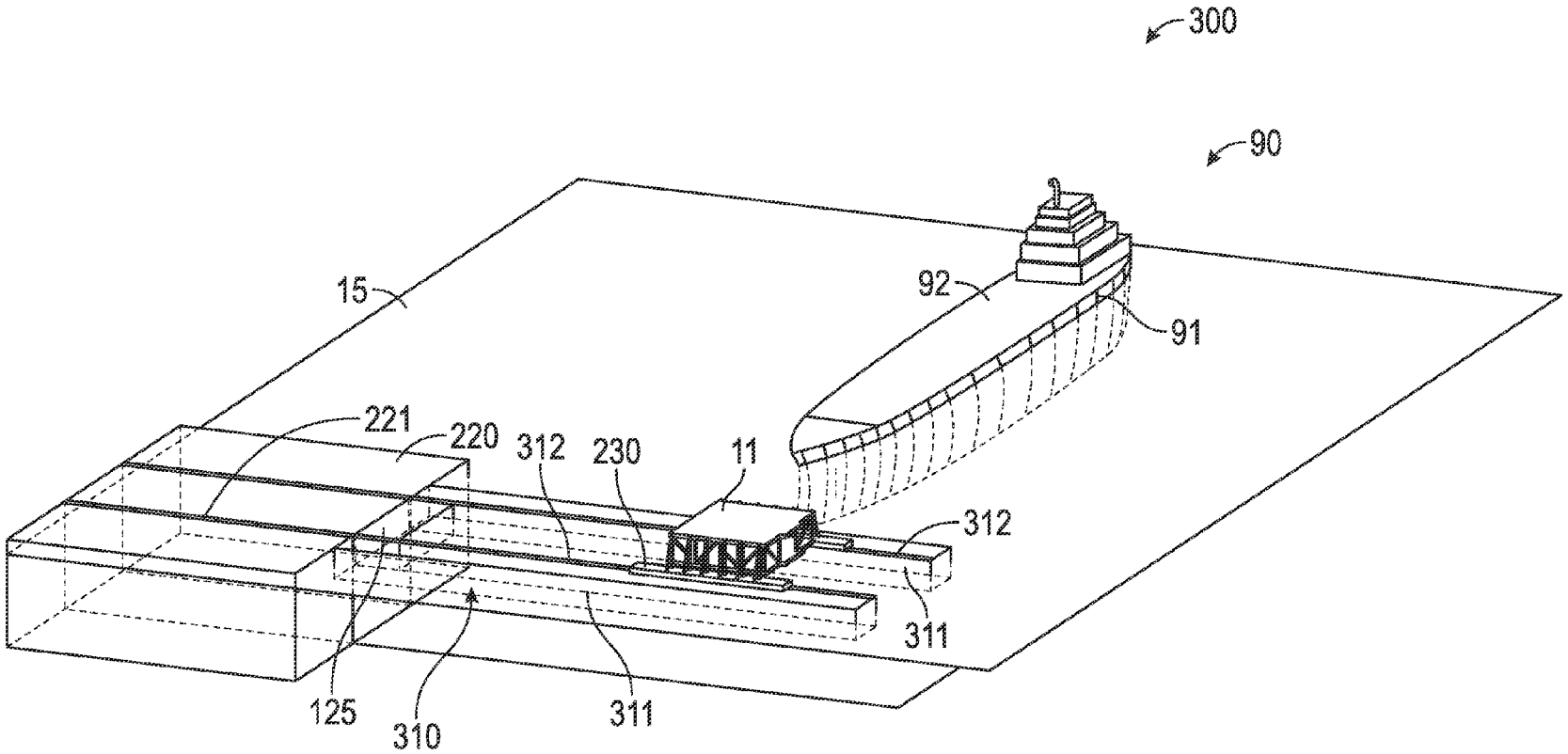

Referring now to FIGS. 18 and 19, module assembly 11 is secured to support members 81 mounted to each carriage 230 (e.g., with bolts), and moved from integration area 220 onto rail assembly 310 via carriages 230 and rails 221, 312.

Figure 20:
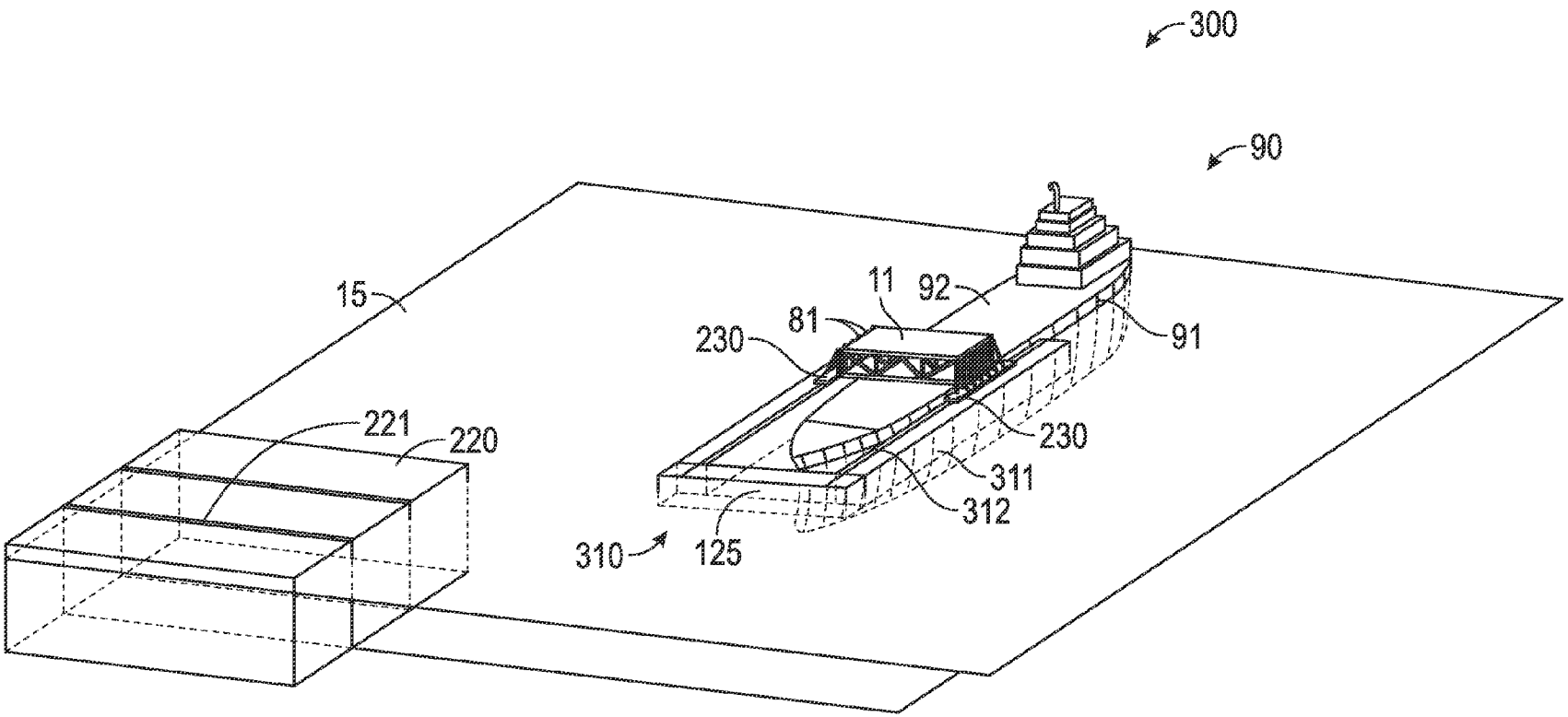

Moving now to FIGS. 19 and 20, rail assembly 310 is decoupled and released from integration area 220, and carries module assembly 11 from integration area 220 to vessel 90. Vessel 90 is ballasted and/or pontoons 311 are de-ballasted to position module assembly 11 at a height above deck 92. Next, vessel 90 is positioned between pontoons 311 with deck 92 below module assembly 11. Vessel 90 and/or carriages 230 may be moved to position module assembly 11 directly above the desired landing site on deck 92.

Figure 21:
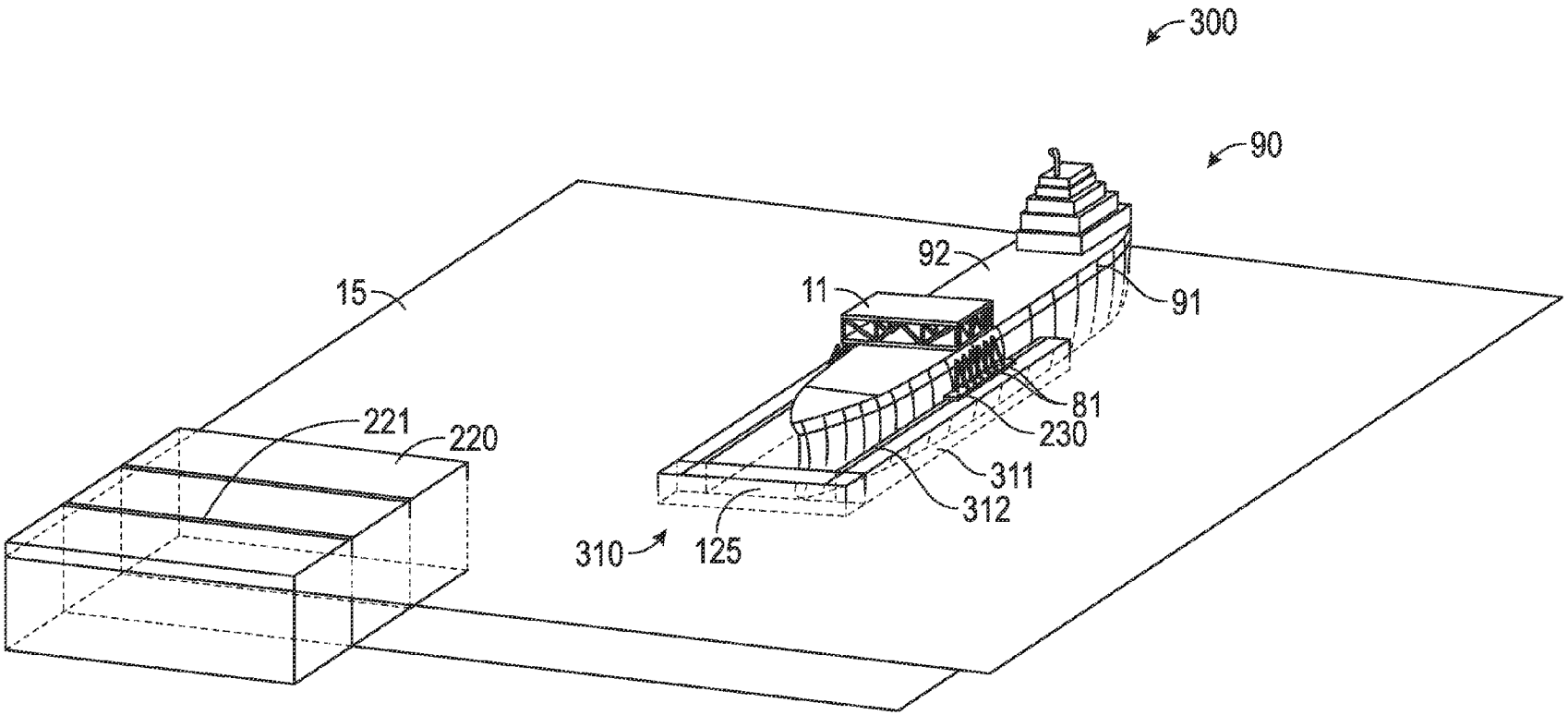

Moving now to FIGS. 20 and 21, vessel 90 is de-ballasted and/or pontoons 311 are ballasted to position assembly 11 on deck 92. Assembly 11 is then de-coupled from support structure 80 and installed on deck 92. Once disconnected from assembly 11, rail assembly 310 may be moved back to integration area 220. In this manner, pre-assembled and pre-integrated module assembly 11, which may be too heavy to load with cranes, is loaded and installed on deck 92. One or more additional pre-assembled and pre-integrated module assemblies may be loaded and installed on deck 92 in the same manner.

It should be appreciated that this embodiment allows the transfer of module assembly 11 from rail assembly 310 to vessel 90 at a distance from integration area 220. As a result, assembly 310 and/or vessel 90 may be ballasted to a greater degree in such offshore deeper waters.

As previously described, in this embodiment, module support system 80 is employed to releasably connect to module assembly 11, and support assembly 11 as it is positioned over vessel 90. However, in other embodiments, module support system 80 of system 300 can be replaced with module support system 180 previously described.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for constructing an FPSO, comprising:

(a) assembling and integrating a plurality of modules to form a module assembly for installation on the FPSO;

(b) releasable coupling the module assembly to a support system coupled to one or more ballast adjustable pontoons after (a);

(c) supporting the module assembly with the one or more ballast adjustable pontoons after (b);

(d) positioning the module assembly over a deck of a vessel after (c);

(e) supporting the module assembly over the deck of the vessel with the support system during (d);

(f) de-ballasting the vessel and/or ballasting the one or more pontoons to load the module assembly onto the deck of the vessel after (e); and (g) decoupling the module assembly from the support system after (f).

2. The method of claim 1, further comprising:

transporting the module assembly on a first barge;

transferring the module assembly from the first barge to a second barge, wherein the second barge comprises a first plurality of the one or more ballast adjustable pontoons arranged in a first vertical wall and a second plurality of the one or more ballast adjustable pontoons arranged in a second vertical wall oriented parallel to the first vertical wall and spaced therefrom;

positioning the vessel between the first wall and the second wall during (d).

3. The method of claim 2, wherein transferring the module assembly from the first barge to a second barge comprises:

ballasting the second barge;

coupling the module assembly to the one or more pontoons;

de-ballasted the second barge to lift the module assembly from the first barge.

4. The method of claim 1, further comprising:

coupling the module assembly to a pair of carriages;

moving the carriages along a pair of rails supported by the one or more ballast adjustable pontoons; and positioning the vessel between the pair of rails.

5. The method of claim 4, further comprising moving the rails from an integration area to the vessel.

6. A system for installing a pre-assembled and pre-integrated module assembly on a vessel disposed in a body of water to form an FPSO, the system comprising:

a floating vessel configured to be ballasted and de-ballasted;

a pair of horizontally spaced parallel pontoons defining an open bay configured to receive the floating vessel, wherein each pontoon is ballast adjustable; and a support system coupled to the pontoons and configured to support the module assembly over the open bay;

wherein the pontoons are vertically oriented and are disposed on opposite sides of a U-shaped barge.

7. The system of claim 6, wherein the U-shaped barge includes a horizontal base and a pair of vertical walls extending perpendicularly upward from the base;

wherein each wall comprises a plurality of ballast adjustable pontoons.

8. A method for constructing an FPSO, comprising:

(a) assembling and integrating a plurality of modules onshore to form a module assembly for installation on the FPSO;

(b) coupling the module assembly to a support system moveably disposed on a plurality of rails after (a);

(c) moving the module assembly along the rails to a position over a deck of a vessel; and (d) transferring the module assembly from the support system to the deck of the vessel after (c).

9. The method of claim 8, wherein (d) comprises de-ballasting the vessel to lift the module assembly from the support system.

10. The method of claim 8, wherein each rail is supported over the surface of water by an elongate ballast adjustable pontoon.

11. The method of claim 10, wherein the rails and corresponding pontoons are spaced apart.

12. The method of claim 11, further comprising positioning the vessel between the pontoons.

13. The method of claim 12, further comprising ballasting the pontoons.

14. The method of claim 8, wherein each rail is supported over the surface of water by a plurality of piles extending upward from the sea floor.

15. The method of claim 14, further comprising positioning the vessel between the rails.

16. A system for installing a pre-assembled and pre-integrated module assembly on a vessel disposed in a body of water to form an FPSO, the system comprising:

an integration area including a pair of first rails;

a plurality of second rails extending from the integration area over the surface of water, wherein each second rail is aligned with one of the first rails;

a carriage moveably coupled to each first rail and each second rail; and a support system coupled to the carriages and configured to support the module assembly.

17. The system of claim 16, wherein each of the second rails is supported over the surface of water with a plurality of piles extending upward from the sea floor.

18. The system of claim 16, wherein each of the second rails is supported over the surface of water with a pontoon, wherein each pontoon is configured to be ballasted and de-ballasted to raise and lower the pontoon relative to the surface of water.

19. The system of claim 18, wherein the plurality of second rails are releasably coupled to the integration area.

20. The system of claim 16, wherein the first rails are spaced apart.

* * * * *